US010752324B2

(12) United States Patent
Fitzpatrick

(10) Patent No.: US 10,752,324 B2
(45) Date of Patent: Aug. 25, 2020

(54) PIPE CONTAINMENT SYSTEM FOR SHIPS WITH SPACING GUIDE

(71) Applicant: GEV Technologies Pty. Ltd., West Perth, Western Australia (AU)

(72) Inventor: Patrick John Fitzpatrick, Calgary (CA)

(73) Assignee: GEV TECHNOLOGIES PTY. LTD., West Perth, Western Australia (AU)

( * ) Notice: Subject to any disclaimer, the term of this patent is extended or adjusted under 35 U.S.C. 154(b) by 0 days.

(21) Appl. No.: 16/236,902

(22) Filed: Dec. 31, 2018

(65) Prior Publication Data

US 2020/0207449 A1 Jul. 2, 2020

(51) Int. Cl.

| | |
|---|---|
| ***B63B 25/14*** | (2006.01) |
| ***F17C 1/00*** | (2006.01) |
| ***F17C 5/06*** | (2006.01) |

(52) U.S. Cl.

CPC ..... *B63B 25/14* (2013.01); *F17C 1/002* (2013.01); *F17C 5/06* (2013.01); *F17C 2201/0138* (2013.01); *F17C 2205/013* (2013.01); *F17C 2209/221* (2013.01); *F17C 2223/0123* (2013.01); *F17C 2225/0123* (2013.01); *F17C 2270/0105* (2013.01)

(58) Field of Classification Search

CPC ..... B63B 25/14; F17C 1/002; F17C 5/06

See application file for complete search history.

(56) References Cited

U.S. PATENT DOCUMENTS

| | | | | |
|---|---|---|---|---|
| 3,828,708 A * | 8/1974 | Gerwick, Jr. | ..... | B63B 5/18 114/65 A |
| 5,803,005 A | 9/1998 | Stenning et al. | | |
| 5,839,383 A | 11/1998 | Stenning et al. | | |
| 6,003,460 A | 12/1999 | Stenning et al. | | |

(Continued)

FOREIGN PATENT DOCUMENTS

| | | |
|---|---|---|
| CA | 2283008 A1 | 3/2001 |
| EP | 2179889 | 5/2009 |

(Continued)

OTHER PUBLICATIONS

ISA/CA, International Search Report and Written Opinion for PCT/CA2019/051887, dated Mar. 5, 2020.

(Continued)

*Primary Examiner* — Stephen P Avila

(74) *Attorney, Agent, or Firm* — James F. Lea, III; Gable Gotwals

(57) ABSTRACT

An assembly for storing and transporting compressed fluid, such as compressed natural gas, that includes a plurality of hexagonally stacked pipe stored in a cargo hold in or on a vessel, that includes a lower support, side supports and a forcing mechanism that presses strongly down on the pipes so that they cannot move relative to themselves or the vessel on which they are placed. The friction between the pipes causes the plurality of pipes to act as part of the vessel in terms of its structure. The stacked pipe is supported by a plurality of spacers, such as convex side up pipe segments for maintaining a gap between adjacent ones of said plurality of pipes in a same row in said stacked pipe. A load equalizer may be located above the plurality of pipes for distributing the compressive force from the forcing mechanism.

51 Claims, 23 Drawing Sheets

(56) References Cited

U.S. PATENT DOCUMENTS

| | | | | |
|---|---|---|---|---|
| 6,240,868 | B1 | 6/2001 | Fitzpatrick et al. | |
| 6,584,781 | B2 | 7/2003 | Bishop et al. | |
| 8,091,495 | B2 * | 1/2012 | Donnelly | B63B 5/14 114/256 |
| 9,376,049 | B2 | 6/2016 | Campbell | |
| 9,759,379 | B2 | 9/2017 | Fitzpatrick | |
| 9,975,609 | B2 | 5/2018 | Fitzpatrick et al. | |
| 2004/0216656 | A1 | 11/2004 | Fitzpatrick et al. | |
| 2007/0014636 | A1 | 1/2007 | Breivik et al. | |
| 2020/0011481 | A1 * | 1/2020 | Fitzpatrick | B63B 25/14 |

FOREIGN PATENT DOCUMENTS

| | | |
|---|---|---|
| WO | 98/14362 | 4/1998 |
| WO | 2018/027308 A1 | 2/2018 |

OTHER PUBLICATIONS

European Patent Office, Extended European Search Report for 17838251.1, dated Feb. 26, 2020.

* cited by examiner 10
12
14
40
26
24
3
3
22

12
16
18
20
6
22
40
14
10

USED IN DESIGN

PIPE CONTAINMENT SYSTEM FOR SHIPS WITH SPACING GUIDE

FIELD OF THE INVENTION

The invention relates to an apparatus and method for the marine storage and transport of gases, such as natural gas.

BACKGROUND OF THE INVENTION

There are known methods of transporting natural gas across bodies of water including for example, through subsea pipelines, by LNG ships as liquefied natural gas or by CNG ships as compressed natural gas (CNG). There are other known means such as converting the gas to gas hydrates or to a diesel-like liquid (GTL) and shipping the hydrates or GTL by ship. Currently, virtually all transport of natural gas across bodies of water is carried out by either subsea pipelines or LNG ships.

The transport of liquefied natural gas (LNG) on ships is a large, well established industry but the transport of compressed natural gas (CNG) by ships or barges is almost non-existent. One of the major impediments to shipping CNG by sea is the cost of a CNG containment system that is suited to ship or barge transport. Thus, there is an ongoing need to design storage systems for compressed gases, such as CNG, that can contain large quantities of CNG and that are particularly suited to installation on or within ships and barges in a way that reduces the overall cost of the CNG ship or barge.

The terrestrial transport of CNG by truck is well known. For decades CNG has been transported in tube-trailers. CNG is a common fuel for motor vehicles and a variety of CNG storage tanks are available for storing fuel in a motor vehicle. Also pipes of various dimensions are often transported by truck or in ships or on barges. It is well known in these industries that by strapping or holding down hexagonally stacked pipe with sufficient force enough friction can be generated to restrict pipes from slipping out of the stack under normal loads. Sometimes a frictional material is placed between the pipe layers to enhance the friction. However, none of these solutions have been able to provide a cost effective CNG ship or barge for the bulk transportation of large quantities of CNG.

One of the preferred methods of constructing a CNG containment system for a ship or barge is to stack pipes longitudinally approximately the full length of the barge or ship in a hexagonal, close spaced fashion. One such method is disclosed in Canadian patent number 2,283,008 filed Sep. 22, 1999. The CNG barge described in this patent had installed on its deck a gas storage assembly, which included a stack of horizontally oriented, long pipes stretching approximately the full length of the barge deck. The stacking was close spaced and one aspect of the invention was that the pipe could be stacked hexagonally together touching one another thus creating a friction bond.

While the barge and ship described in Canadian patent no. 2,283,008 is a possible way to transport CNG, the invention did not take into account the motions of a barge or ship as pitches, yaws, and heaves in response to waves, currents and winds. Nor did it take into account the deflection of the barge or ship itself as it bends, twists and otherwise deflects as it is subjected to the loads caused by the waves. Nor did it take into account the expansion and contraction of the pipes as they are exposed to pressure and temperature changes that will occur as the pipes are loaded and emptied of compressed gas. The flexing and accelerations caused by the sea conditions and the differential temperatures and pressures caused by loading and unloading the pipe will cause the pipes to slide and move relative to each other and relative to the barge or ship.

SUMMARY OF THE INVENTION

The invention relates particularly to the marine gas transportation of non-liquefied compressed natural gas, although it could be used to transport other gases. It is an object of the present invention to reduce the cost of ships or barges designed to carry compressed gases, such as CNG.

The invention relates to a gas storage system particularly adapted for the transportation of large quantities of compressed gases, such as CNG, in or on a ship or a barge, primarily by means of long, straight hexagonally stacked lengths of pipe that are so strongly forced together that they cannot move relative to each other or to the ship. The lengths of pipe are connected by a manifold. In one embodiment, i.e., a ship application, CNG is carried below the top deck. However, the invention could also be employed on the top deck of a ship or on the top deck of a barge or below the top deck of a barge. The invention could also be employed to carry compressed gases other than CNG.

The pipe runs almost the entire length of the ship in continuous straight lengths and is hexagonally packed and firmly pressed together by a forcing mechanism. As described in Canadian patent number 2,283,008, the ship can be designed so that the holds of the ship can be the entire length of the ship and if necessary for the stability of the vessel, watertight transverse bulkheads can be accommodated by filling the gaps between the hexagonally stacked pipes with a watertight material at the required intervals. The pipe diameter can be of any reasonable dimension, e.g., from approximately 8 inches to approximately 36 inches or other diameters. The precise diameter and length of pipe will depend on the economics of the system taking into account the cost of the various components making up the system, such as the cost of pipe materials, such as steel, and the connection manifold, at the time and location of construction.

This present invention is comprised of an assembly of long pipes, hexagonally stacked and touching one another. A forcing mechanism is provided that forces the pipes so firmly together that any significant relative movement of the pipe is prevented as the ship, containing this system, moves in an open ocean environment. Secondly, the present invention mitigates any strains caused by the flexing or twisting of the ship by increasing the stiffness of the ship. Thirdly, the present invention prevents any significant relative movement between the individual pipes in the assembly caused by differential temperature or pressure. These goals are accomplished by forcing the pipes so strongly together that the resulting friction between the pipes prevents any pipe from significant movement relative to the other in any circumstance, including the flexing of the ship itself. This requirement goes far beyond any friction element that would normally be employed to prevent slippage of one pipe relative to any other pipe in a stack of pipes transported, e.g., by a truck or ship. The pipes are forced together with sufficient force that it is as if all of the pipes are fastened together in their entirety and to the ship or barge hull by means of a weld. By frictionally locking the pipes together with the forcing mechanism, the overall stiffness of the vessel is increased so that flexing and twisting of the vessel is significantly reduced and so that the assembly of pipes and the vessel move in unison. Increasing the overall strength of a barge or ship by means of forcing a plurality pipe sufficiently together so they act as though they are welded together and welded to the ship is unprecedented and novel. A benefit of the invention is to maximize the amount of CNG stored in the plurality of pipe that is contained within the space available either on the deck or in the holds of a ship or barge and thus create a lower cost means of transporting CNG.

The system includes a lower support and side supports. The side supports are located on each side of the lower support onto which the plurality of pipes can be positioned. The side supports may be approximately perpendicular to the lower support.

The system further includes a plurality of pipes for fluid containment are located between the side support. Each pipe of the plurality of pipes has a means of connection to a manifold system. The plurality of pipes are preferably stacked in a hexagonal manner on the lower support, between the side supports.

A top fixed support is provided that does not move relative to the side supports. However, both the top fixed support, the fixed side supports and the bottom support deflect slightly and elastically as the force is applied.

An upper forcing member is preferably located beneath the top fixed support. The forcing member is free to move up and down relative to the side supports and to forcefully bear down on the stack of pipes to apply compressive force to the plurality of pipes stacked in the hold. The compression force results in sufficient friction between the pipes to:

a. prevent any significant relative motion between the pipes themselves or between the pipes and the lower support, the side supports or the forcing member.
b. accommodate any relative motion of the barge or ship so that the hull of the barge or ship acts in concert with the plurality of pipes. In other words, the plurality of pipes adds to the strength of the barge or ship so that any motion induced by the environment on the ship or barge does not cause any relative motion between the hull and the plurality of pipes.
c. prevent any relative movement of the individual pipes caused by differential pressures and temperatures.
d. allow for adjustments of the force during the first pressure cycle to accommodate any shakedown that may occur.

The forcing mechanism may have bracing to provide longitudinal restraint to the forcing mechanism to prevent any longitudinal movement of the forcing mechanism in any conditions, for example, collision, or movements caused by waves, gas pressure or other factors.

A means of the generating the force on the forcing member is provided, such as a plurality of jacks or other means, including levers, or by bolting each end of the forcing members such that the tension in the bolts would provide the compressive force to the plurality of pipe.

In some cases, a means of spreading the concentrated stresses generated by the compressive force forcing the pipes against the bottom, top, and side supports may be necessary. In such cases, a layer of empty pipe surrounding the gas containing pipe may be provided. Other means of spreading concentrated stresses include wood padding, or other comformable material to allow load spreading.

A means of connecting each of the of pipes to a manifold system for filling and unloading fluid, such as natural gas to the pipes, is provided.

The evaluation of the required confining stress is non-trivial and unique to this invention. The confining force should be sufficient for relative pipe movement to resist all loads, in particular longitudinal forces resulting from any event such as waves, collisions etc. This relationship between these factors is described in the equation below:

N—is the number of gravitational accelerations to which the invention is subjected.
$C_f$—is the coefficient of friction between bare steel pipe (approximately 0.70)
P—is the confining pressure generated by the forcing mechanism described below
L—is the length of the pipe
$d_1$—is the outside diameter of a single pipe
D—is the average of the height and width of the plurality of pipes
$W_p$—is the weight of one pipe plus the weight of the fluid inside the pipe, such as compressed natural gas $$N=C_f P\cdot\pi\cdot L\cdot(d_1)^2/(D\cdot W_p) \quad \text{Equation:}$$

In one embodiment, pipe spacers are located at the bottom of the cargo hold. The pipe spacers are configured such that all the pipes in the cargo hold do not touch one another along their horizontal axes when they expand under the internal pressure of the gas and or expansion due to temperature, i.e., a space exists between pipes in the same row. The space is necessary to prevent very high forces building up and plasticizing the surrounding restraining girders in the deck, bottom shell and side walls. Besides causing over stress in the girders, the prestressing jacking compression would be lost by plasticizing the surrounding structure, and the upper pipes could become loose. The space, therefore, is an important part of the design because the space enables locking in the pre-compression forces from the deck and avoids over stressing of the cargo hold deck, side walls and base.

For a given internal pressure and temperature range the space size is directly related to the pipe diameter, the modulus of elasticity of the material, and the strength of the material. In one embodiment, the material is steel with a yield strength of 80 ksi and the maximum hoop stress allowed is about 70% of its yield strength and the temperature change in about 60 degrees centigrade. The space is preferably from approximately 1.5% to approximately 3% of the pipe outer diameter. More preferably, the space is from 2% to 2.5% of the pipe outer diameter. Most preferably, the space is ideally about 2% of the pipe diameter. Larger spaces are possible but larger spaces start to have a slightly negative effect on the uniformity of the stacking. Other materials and other strengths will have slightly different ideal space ranges. For example, if higher strength steel is utilized then the ideal space may increase from 2% to 3%, e.g., for 160 ksi steel.

In one embodiment, pressure from the forcing beam is evened out over the top row of pipes of the pipe stack with a force equalizer. Typically, the pipes in the topmost row are not completely level. There may be some unevenness due to the accumulation of very slight differences in pipe diameter, which is common with produced pipes. In one embodiment, pressure may be evenly distributed by providing a force equalizer in the form of wedges located between adjacent pipes. In another embodiment, pressure may be evenly distributed by adding a form of equalizer in the form of a smoothing layer of a flowable material, e.g., a concrete "lid" on the topmost layer.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. In particular, the top support member could be designed to also be the forcing member. Accordingly, the drawings and detailed description are to be regarded as illustrative in nature and not as restrictive.

BRIEF DESCRIPTION OF THE DRAWINGS

Referring to the drawings, several aspects of the present invention are illustrated by way of example and not by way of limitation, wherein.

DETAILED DESCRIPTION OF THE PREFERRED EMBODIMENTS

Figures 1, 2:
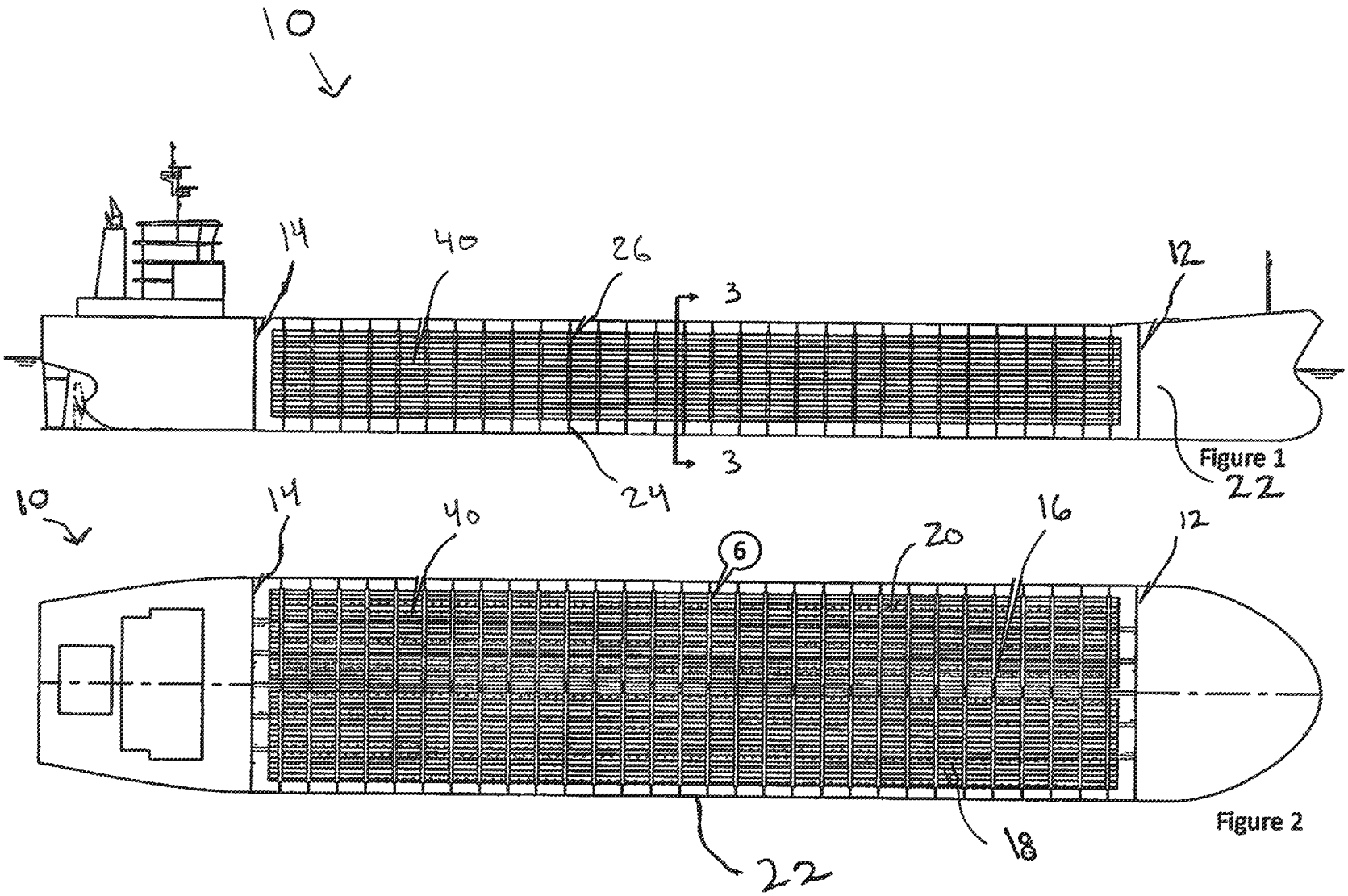
FIG. 1 is a side elevation of a ship according to the present invention.
FIG. 2 is a plan view of ships according to the present invention

The description that follows and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

A compressed gas transport assembly is disclosed. The assembly of the invention may be installed on or in a ship or barge for marine transport of compressed gas such as CNG. For the purpose of this detailed description of the embodiments a ship is shown with the assembly inside the ship's hull. This is intended as a means of describing the invention and is not a limitation. It is readily apparent to those skilled in the art that the assembly could be modified to be placed on the deck of a ship or barge, or in the hull of a barge.

Referring to FIG. 1, shown is a side elevation of a transport vessel, designated generally 10. In one embodiment, transport vessel 10 is a ship. Other examples of transport vessels include barges. In one embodiment, transport vessel 10 includes forward cargo bulkhead 12, an aft cargo bulkhead 14, and a centerline longitudinal bulkhead 16. Gas transport assembly is enclosed within the hull of the ship, contained between forward cargo bulkhead 12 and aft cargo bulkhead 14. Centerline longitudinal bulkhead 16, shown in FIG. 2, divides transport vessel 10 into two cargo holds, i.e., starboard cargo hold 18 and port cargo hold 20. Transport vessel 10 includes a hull 22. Bottom support members 24 may be incorporated into a bottom of hull 22. A plurality of pipes 40 is supported on bottom support members 24. Transport vessel 10 further includes a plurality of side support members 26, which may be part of the side of hull 22 of transport vessel 10 and may be part of centerline longitudinal bulkhead 16. Side support members 26 are spaced along the length of cargo holds 18 and 20, typically equally spaced and aligned with each other as shown in FIGS. 1 and 2. This embodiment of the invention shows that the cargo holds 18 and 20 are free from any transverse bulkheads so that pipes can stretch almost the entire length of the cargo hold. If water tight transverse bulkheads are required, then these can be provided by means disclosed in Canadian Patent No. 2,283,008, such as placing a sealing material between the spaces formed by the hexagonally stacked pipes. Transport vessel 10 further includes a fixed top support member 28. Fixed top support member 28 is part of the top deck of transport vessel 10.

Figure 3:
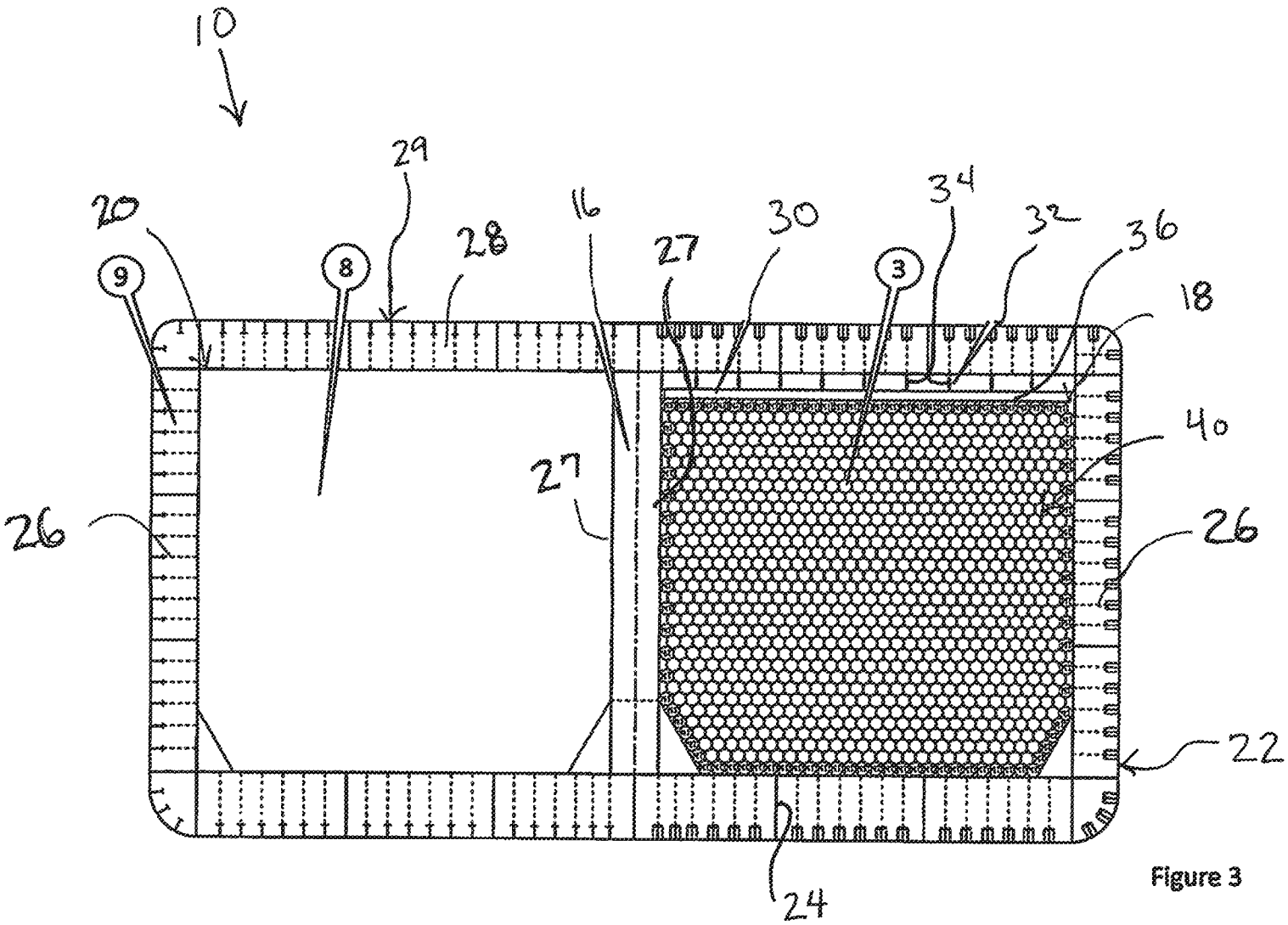
FIG. 3 is a section along 3-3 of FIG. 1, wherein a gas storage assembly according to the invention is more clearly shown.

Referring to FIG. 3, shown is a cross-section taken along line 3-3 of FIG. 1. For illustrative purposes, FIG. 3 shows port cargo hold 20 without a plurality of pipes and shows starboard cargo hold 18 with plurality of pipes 40 located therein. In practice, both port cargo hold 20 and starboard cargo hold 18 would be filled with pipe. Hull 22 of transport vessel 10 surrounds port cargo hold 20 and starboard cargo hold 18. In one embodiment, hull 22 incorporates outside vertical support members 26, top support members 28 and bottom support members 24. Longitudinal bulkhead 16 is part of the structure of transport vessel 10 and also incorporates inner side support members 27.

Top forcing members 30 (FIG. 3) are spaced so top forcing members 30 align with the side support members 26, but are not connected to them. Centerline bulkhead 16 separates port cargo hold 20 and starboard cargo hold 18 and may incorporate the interior side support members 27. Forcing member 30 is shown with a forcing mechanism 32 being a plurality of jacks 34 between forcing beam 36 and fixed top support member 28, which is part of the top deck of transport vessel 10. Other means of generating the force required are contemplated, including compression springs that when forced down between the deck and the forcing member creates the required force during the installation of the deck create the required force to impart the required pressure on the pipes. The force provided by forcing mechanism 32 must be substantial enough to prevent movement of the pipes, designated generally 40, as described previously. In the embodiment of the invention described here, the approximate range of force per jack 34 is between 25 tonne and 125 tonne.

Figures 4A, 4B, 4C:
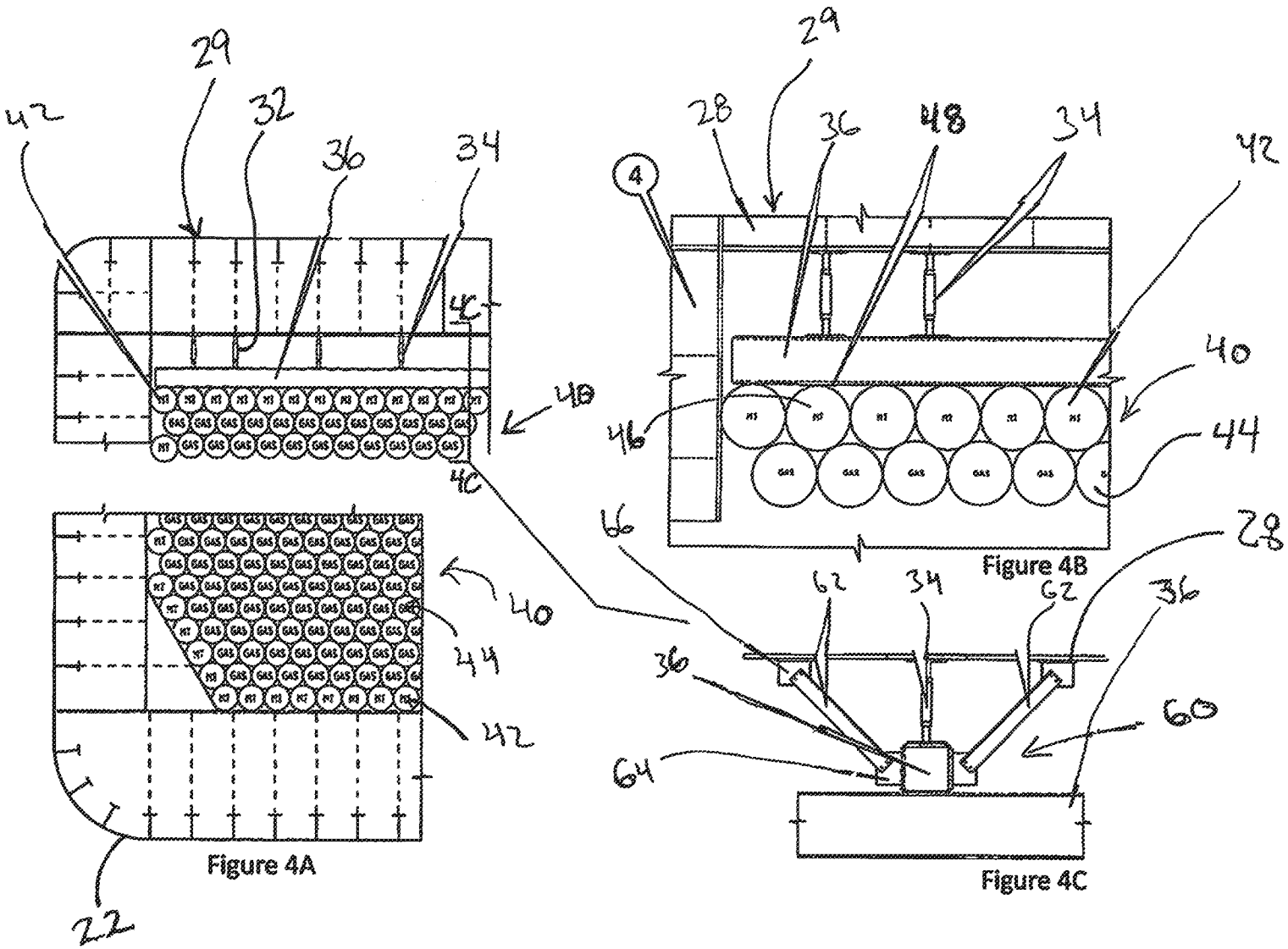
FIG. 4A is an enlarged portion of FIG. 3 showing the forcing beam 6, and the forcing mechanism, which in this case is a series of jacks 10, to create the force on the forcing beam.
FIG. 4B is an enlarged portion of FIG. 4A showing how the force from the forcing beam can be exerted on all of the pipe, even if one or more pipes are not flush with the forcing beam through the provision of shims to take up any gaps.
FIG. 4C is a section 4C-4C of FIG. 4A showing how the forcing beams may be braced to resist the substantial longitudinal forces caused by the ships motion to ensure that the forcing beams do not move relative to the pipes.

Referring to FIG. 4A, an enlarged view of portions of FIG. 3 is shown. Plurality of pipes 40 include empty pipe 42 and gas filled pipe 44. The plurality of gas filled pipes 44 may be surrounded by a layer of empty pipe 42 that will always be empty. The empty pipe 42 is denoted as 'MT' in the figures and the gas filled pipe 44 is denoted as 'GAS'. The purpose of empty pipe 42 is to distribute the loads generated by forcing mechanism 32 as it pushes empty pipes 42 against support members 24, 26, 27. Empty pipes 42 distribute the concentrated load into gas containing pipes 44 to avoid concentrated loading of gas carrying pipes 44. Other means of spreading the load such as using wooden poles or other materials are also contemplated. It is also contemplated that the no load spreading may be required and so gas filled pipes 42 may directly contact support members 24, 26, 27.

Referring to FIG. 4B, one of empty pipe 42, i.e., low pipe 46, is shown to be slightly lower than forcing beam 36, which creates a gap. The gap could be caused by small differences in pipe geometry such as variances in diameter, out of roundness or other such differences. The gap could be found by visual inspection prior to applying forcing mechanism 30. Shims 48 may be driven in the gap if the gap is visually obvious. If the gap is not visually obvious then the tightening of jacks 34 will ensure that some give will occur in one of pipes 40 and that the load will be equally shared. Also shown in FIG. 4B is the fixed top support member 28, which is preferably fixed to the side support members 26. In this embodiment, the support members 26 are integrated into the hull 22 of transport vessel 10. Other preferred means of accommodating these gaps are also contemplated, as discussed below, such as providing a blanket of material such as lightweight concrete, to accommodate any gaps in the pipe or by fixing wedges to the forcing beam so that the force can be imparted to the pipe even if gaps exist.

Referring to FIG. 4C, bracing structure 60 may be provided for bracing forcing beam 36 in the longitudinal direction to prevent any longitudinal loads pushing forcing beam 36 out of alignment. Bracing arms 62 provide support for forcing beam 36 in the longitudinal direction. Bracing arms 62 are firmly secured after the forcing beam 36 has been fully loaded by jacks 34 of forcing mechanism 32. One way to secure bracing arms 62 would be through a bolted flange 64 on forcing beam 36 and a similar bolted flange 66 affixed to top support member 28.

Figure 5A:
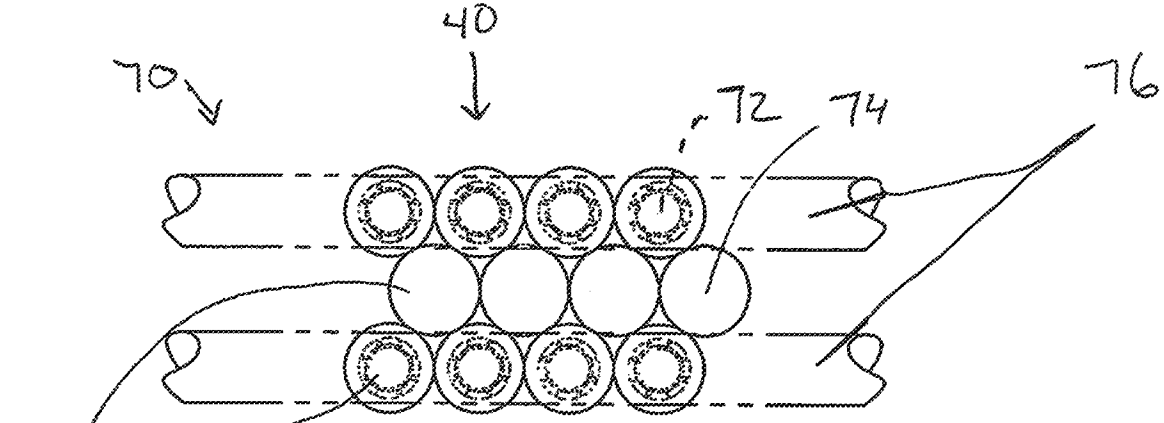
FIG. 5A is a front elevation view of a small portion of the manifold system showing two of the manifold pipes joining two rows of the plurality of pipes containing gas.
Figure 5B:
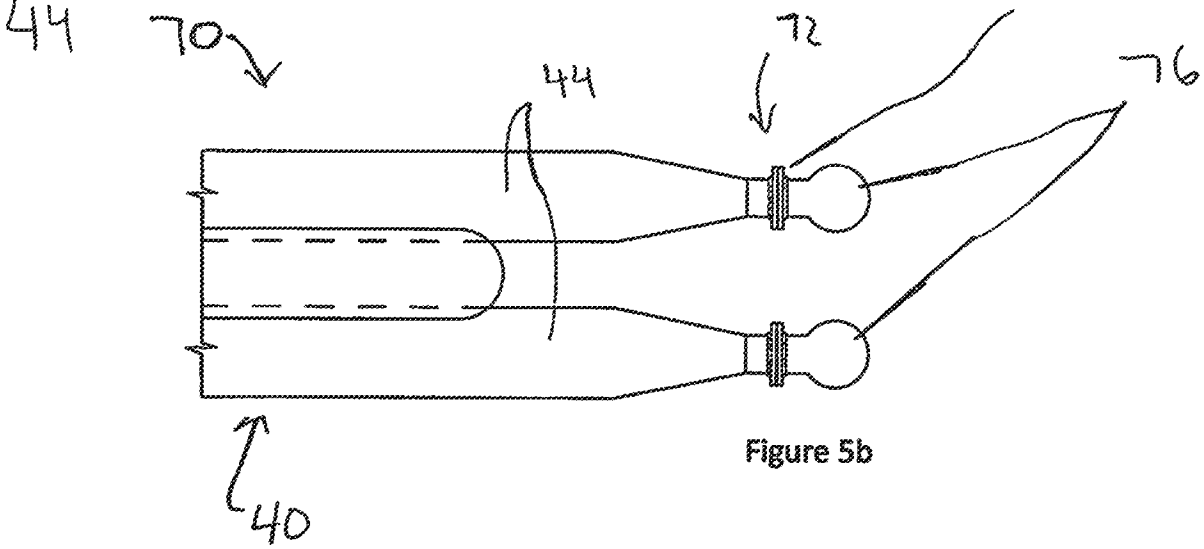
FIG. 5B is a side elevation view of a small portion of the manifold showing how the manifold is connected the gas containing pipes.

Referring to FIGS. 5A and 5B, shown is a manifold system designated generally 70 for filling each gas containing pipe 44 with compressed gas. There are many ways to provide a manifold system and these methods are generally known. FIGS. 5A and 5B show one embodiment of manifold system 70 that maximizes the space for connection. Each pipe of the plurality of pipes 40 preferably has one tapered end 72 and one closed end 74. Pipes 44 are stacked so that each adjacent touching row has open tapered end 72 at alternating sides of the assembly. For example, all of tapered open ends 72 of the odd numbered rows may be stacked so that open tapered ends 72 are forward and all of the even rows may be stacked so open tapered ends 72 are aft. Each row of gas containing pipe 44 is connected to a manifold pipe 76. In this embodiment, the connection is by means of a bolted flange 78. This and other joining mechanisms are well known, such as welding.

Lateral and Vertical Design Pressures

Figure 6:
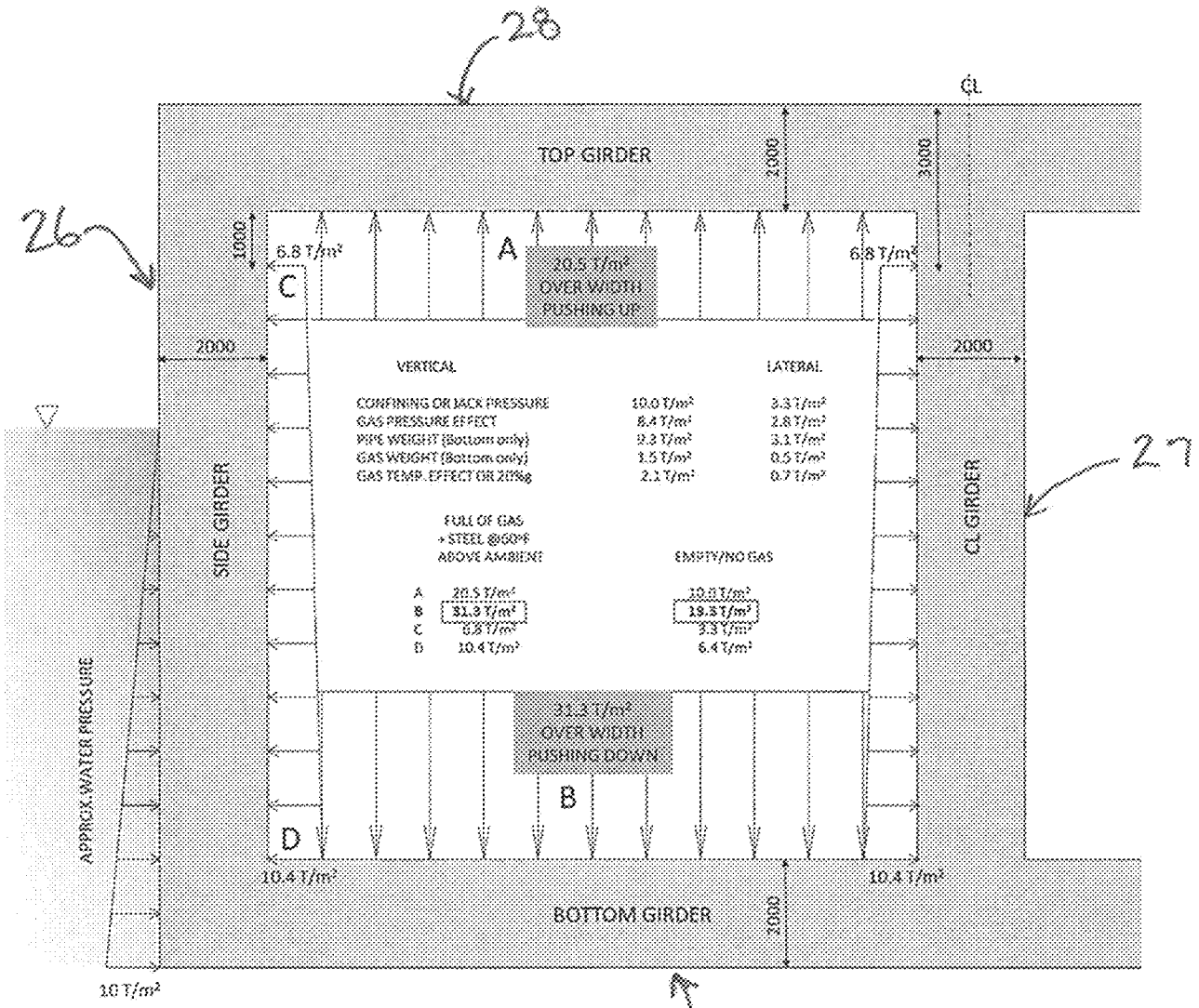
FIG. 6 is a graphical representation of forces acting on girders of a vessel, showing pipe locations A, B, C and D.

Referring to FIG. 6, in one embodiment, pipe 40 is 16 inches OD with a wall thickness of 0.525 inches. The hoop tensile stress caused by the operating pressure of 3600 psi is 53 ksi. In addition to this stress there exist membrane and axial stresses caused by confining pressure and motions of transport vessel 10. The membrane and axial stresses vary depending on whether pipe 40 is at the top or bottom of stacked pipes 40.

Pipes 40 are stacked on top of one another in a nested fashion. A deliberate minimum space of 6 mm may be provided between adjacent ones of pipes 40 within a row (see, e.g., FIG. 7). The space between adjacent pipes 40 avoids jamming of pipes 40. Without the potential of jamming, pipes 40 behave in a manner similar to "leaf springs" and are relatively soft in vertical stiffness compared to pipes 40 in a jammed condition. Maintaining relative softness in vertical stiffness provides an advantage of not causing any plasticity in the confining girders of bottom support member 24, outside support member 26, inside support member 27, and top support member 28 (under gas expansion), which could cause a loss in the confining or jacking pressure.

The pressures in the vertical direction, in turn, create reactionary lateral pressures from the side vertical girders of outside support member 26 and inside support member 28.

Figure 8:
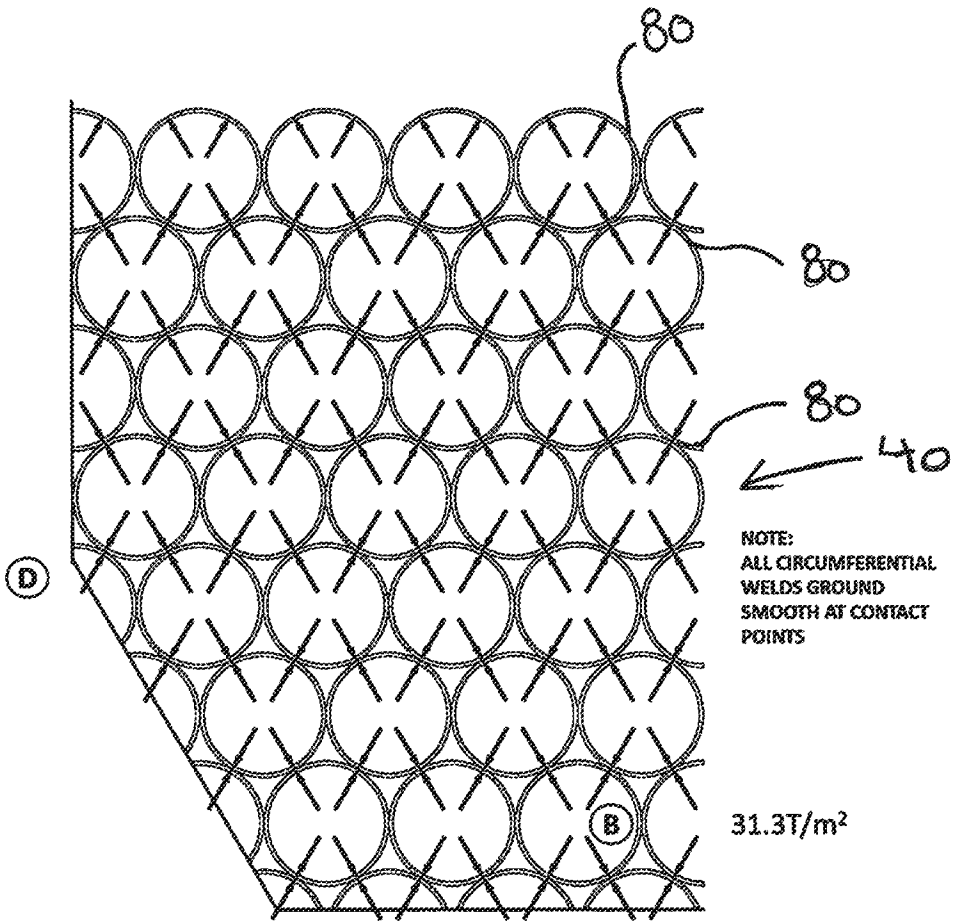
FIG. 8 is a cross-sectional view of pipes stacked above a bottom of the hull of a vessel showing force vector triangles showing pipe locations B and D.
Figure 13:
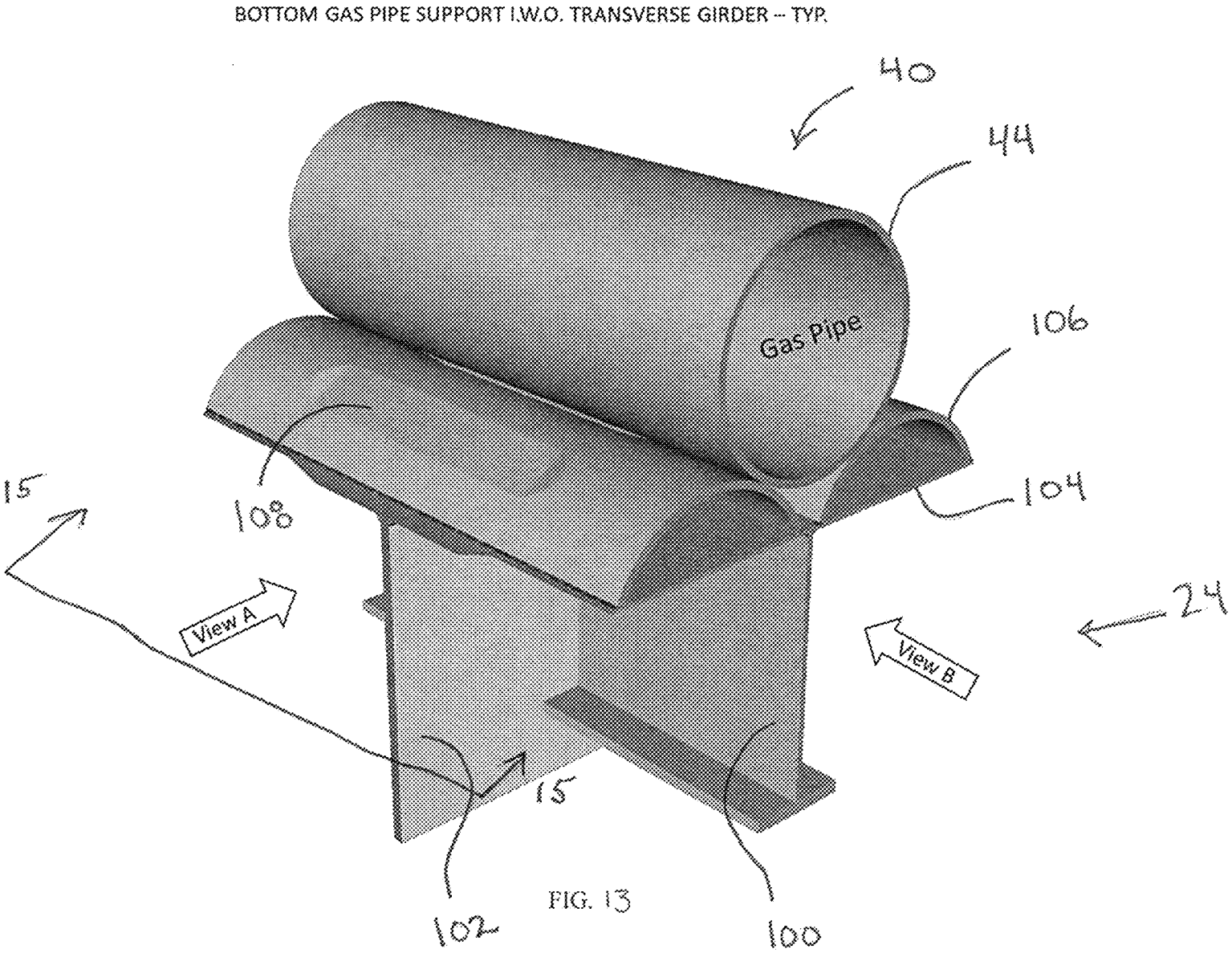
FIG. 13 is a perspective view of the pair of bottom support arches of FIG. 12 showing a gas pipe located thereon.

In one example, the pipe of plurality of pipes 40 located at the bottom (i.e., proximate location B of FIG. 6) experience the greatest membrane stresses. The bottom support members 24 of the floor see a maximum pressure of 31.3 T/m$^2$. In one example, the bottom transverse girders of bottom support members 24 are spaced at 4 meters; the bottom transverse girders 102 (see FIG. 13) will have a UDL of 125.2 tonnes per meter run as a result). Gas pipes 40 experience the pressure at four load points as shown in FIG. 8 location B.

In this example, the maximum pressure of 31.3 T/m$^2$ consists of the following components as noted in Table 1 below.

TABLE 1

| Description | Pressure in t/m$^2$ | Single Vector load in kips/inch run, 4 vectors per pipe. | Maximum Bending moment in kip-inches /inch | Membrane stress in pipe at location B | Comments Location of maximum stress is at tips of horizontal axis |
|---|---|---|---|---|---|
| Confining or jacking pressure | 10 | 0.13 | 0.22 | 4.8 | Section modulus is 0.046 in$^3$/in |
| Gas pressure effect | 8.4 | 0.11 | 0.19 | 4.0 | |
| Pipe weight | 9.3 | 0.12 | 0.21 | 4.5 | |
| Gas weight | 1.5 | 0.02 | 0.03 | 0.7 | |
| Gas temperature effect or 20% g | 2.1 | 0.03 | 0.05 | 1.0 | |
| Total of all the above | 31.3 | 0.40 | 0.70 | 15.0 | Adding a pressure concentration factor (1.05) raises 15 ski to 15.8 ksi (FIG. 14) |

An explanation of the relationship between columns of Table 1 follows. As an example, a confining or jack pressure is administered to pipes 40 by jacks 34 of 10 t/m$^2$. The 10 t/m$^2$ confining pressure results in a load of 4 t/m for a single one of pipes 40 or 0.4 meters by 10 t/m$^2$ (pipe diameter by pressure). 4 t/m is 0.22 kips/inch, which is resolved into two vector sat load points 80, each with a value 0.22/2/Cos 30 degrees or 0.13 kips per inch as in column 2. These four vectors of 0.13 kips per inch produce a bending moment that varies symmetrically around the wall of pipe 40. Moments, deflections, and membrane stresses are calculated using standard textbook formulae known in the art.

The Confining or Jacking pressure. (10 t/m$^2$)

The confining or jacking pressure acts vertically. The confining pressure is applied from the top and is reacted upon equally from the bottom of transport vessel 10. The confining or jacking pressure is applied as a permanent load condition. When pipes 40 are unjammed, the resulting lateral pressure is approximately ⅓ of the confining or jacking pressure. This relationship occurs for all pressures and it can be seen in FIG. 6 that the pressures at locations C (6.8 T/m$^2$) and D (10.4 T/m$^2$) are approximately ⅓ the pressures of A (20.5 T/m$^2$) and B (31/3 T/m$^2$).

Still referring to FIG. 6, the top transverse girders of top support member 28 and bottom transverse girders 102 of bottom support members 24 see a similar design load. The top sees an upwards pressure of 20.5 t/m$^2$ (82 t/m run) and the bottom transverse girders 102 see about 31.3 t/m$^2$ less the external head of around 10 t/m$^2$ (total 85 t/m run). These produce a design moment of about 10,000 kip-feet in each with a resultant stress of about 30 ksi max. Since the yield of EH36 is 51 ksi this is still well within the elastic capacity of the girders. The limit state or plastic capacity of the girders is estimated at around 20,000 kip-feet. The applied shear is around 1200 kips and the ultimate shear resistance is around 2100 kips assuming a 2000 by 20 stiffened web. The elastic deflection in mid span of transverse girders 102 under full load is around 6 mm. Under the jacking pressure of 10 t/m$^2$ the top girder of top support member 28 will deflect upwards around 3 mm or so in its mid-span.

Gas Pressure Effect. (8.4 t/m$^2$)

When gas filled pipes 44 of plurality of pipes 40 are pressured to 3600 psi with gas, the circumference of pipe 44 elongates in accordance with the physics of a two-dimensional stress system (Poisson's ratio of 0.3). In the example, pipes 44 discussed above, this elongation results in an increase of 0.6 mm in the diameter of pipe 44. In a row of pipes 44, e.g., 30 gas filled pipes 40, the individual increases in diameter of each pipe 44 can amount to an increase of approximately 20 mm for a row. If gas filled pipes 44 are jammed with six more or less equal force vectors, then the overall expansion is unstoppable because gas filled pipe 44 cannot deform. The girders 100, 102 (FIG. 13) of bottom support members 24, the girders of outside support members 26, the girders of internal side support members 27, and the girders of top support members 28 will yield the expanded amount, which would result in some plasticity. The girders will not fail since the effect is self-limiting, but the prestress of gas filled pipe 44 by the confining pressure will be diminished.

When pipes 44 are unjammed, i.e., have a horizontal gap within the rows, expansion of pipe 44 is unable to cause anything more than a minor deformation in the girders (e.g., 2 mm), which is well within the elastic response of the girders. Assuming that the girders are completely rigid results in the unjammed or "leaf spring" pipes 40 being only able to push upwards and downwards with a pressure of 8.4 t/m$^2$. This is a conservative number as there will be some give in the girders, which relaxes this number. In the center of a formation of pipes 40, the relaxation will be around 2 t/m$^2$. The relaxation will be less at the girder supports. Therefore, the girders are conservatively assumed to be unyielding.

Figure 7:
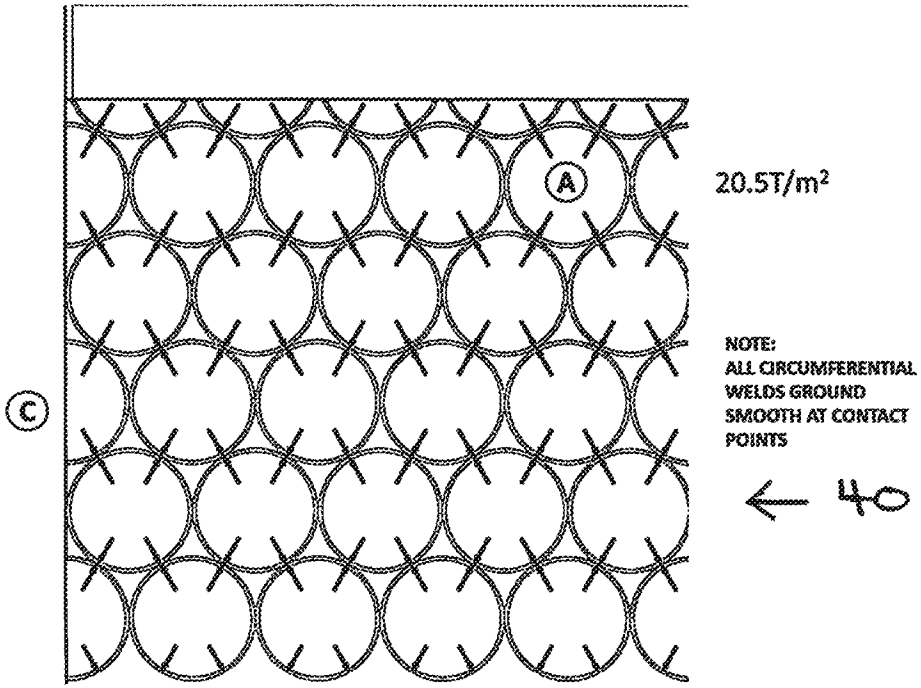
FIG. 7 is a cross-sectional view of pipes stacked beneath the forcing member showing force vector triangles showing pipe locations A and C.

Referring now to FIG. 7, it can be observed that force vectors line up as a series of force triangles. These force triangles find a reaction from side walls 26, 27 and, indeed, all do not go to the bottom. The vectors that intersect sides 26, 27 (both from the top and the bottom) result in a sideways pressure of 0.33 times the vertical pressure (i.e., $(\text{Sin } 30/\text{Cos } 30)^2=0.33$). When a gap of 7 mm is provided between pipes 40 in the same row, the pressure is slightly raised to 0.35.

Referring now to FIG. 8, It can be seen that the unit vectors are about 50% greater at the bottom (i.e., proximate location B) than at the top. The unit vectors represent a pressure of 31.3 t/m$^2$ versus 20.5 t/m$^2$ at the top. Also note that all circumferential welds of pipe 40 are preferably ground smooth in the region of contact points. As a result, the welds will not cause local yielding. Also, it should be noted that, in this example, while the 31.3 t/m$^2$ is realistic for the center of holds 18, 20 (as is the 20.5 t/m$^2$ for the top) these maximum pressures diminish a little towards sides 26, 27 since some of the vectors are putting the vertical girders of side support members 26, 27 into a small degree of compression. A similar effect may be seen in very large grain silos where the bottom of the silo sees a relatively small pressure due to arching of the pressure to the sides. This effect is noted simply to give assurance that the use of the full pressure across the width of the transverse girders is conservative.

Figure 9:
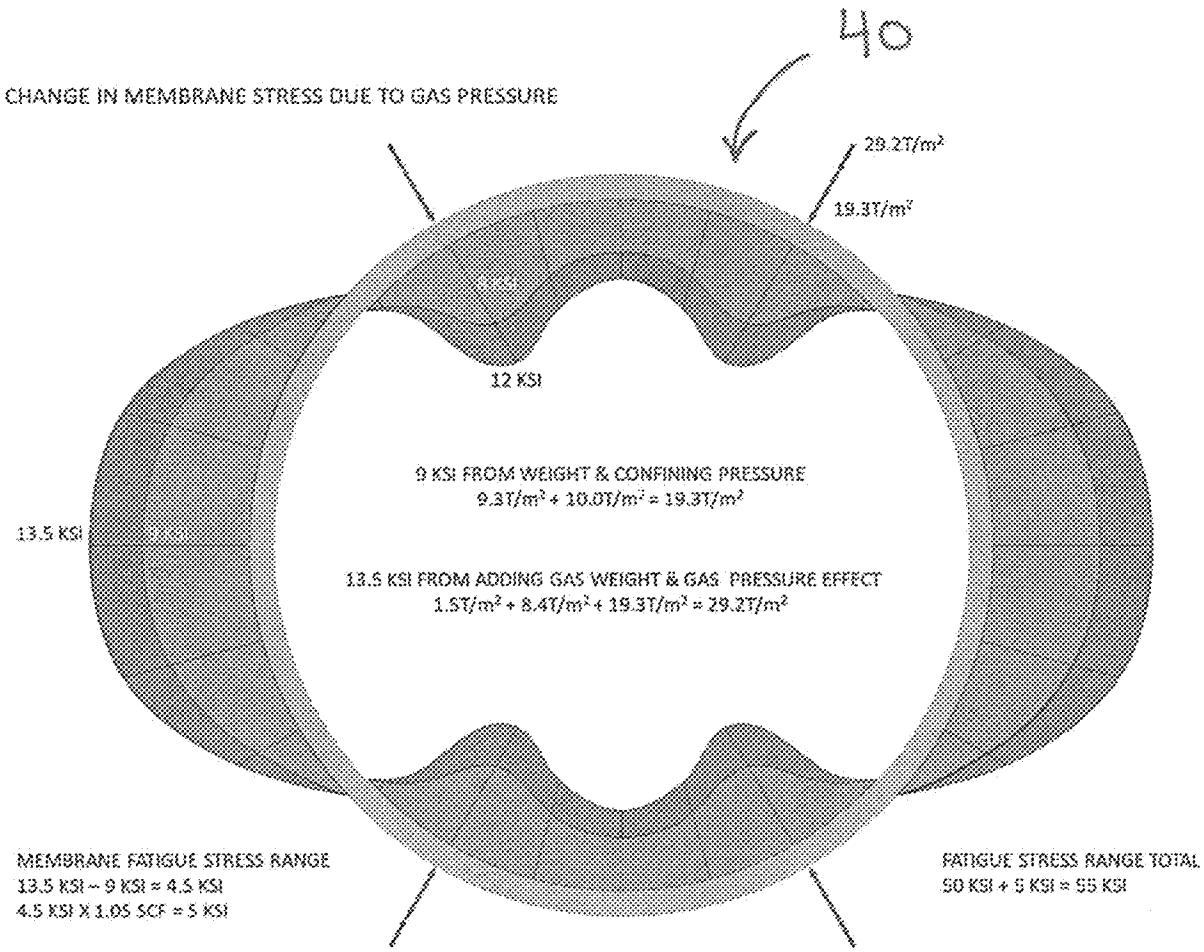
FIG. 9 is a cross-sectional view of a pipe showing membrane stresses from adjacent pipes and showing changes in membrane stress due to gas pressure.

Fatigue Assessment:

Referring now to FIG. 9, American Bureau of Shipping (ABS) have indicated in their guidelines that a factor of 10 be used when assessing design life with appropriate S-N curves based on 3 standard deviations below the mean failure line (as opposed to the more normal industry standard of 2).

Two types of welds may be used in the body of pipes 40, i.e., electric resistance welding (ERW) for the long seam and circumferential joining welds.

The ERW weld is classed between a class B weld and a class C weld, but not lower than a C weld. The circumferential weld is classed as between an E weld and an F weld, but not lower than an F weld.

The relationship between the number of cycles and the stress range can be expressed in the following equation:

$$\mathrm{Log}(N)=\mathrm{Log}(C)-c\delta-m\ \mathrm{Log}(Fsr)$$

Where:

N=the predicted number of cycles to failure under the stress range Fsr

C=a constant relating to the mean S-N curve for that weld.

m=the inverse slope of the mean S-N curve.

c=the number of standard deviations below the mean

δ=the standard deviation of Log (N)

For the ERW weld, the stress range that results from 200 psi to 3600 psi is 345 n/mm$^2$ (50 ksi). For the circumferential weld, the stress range is half of this value or 173 n/mm$^2$ (25 ksi). A membrane stress range of 5 ksi must be added to the 50 ksi as illustrated in FIG. 9 to give a maximum tensile range of 55 ksi or 380 n/mm$^2$.

Inserting numerical values into the equation yields the following number of cycles to failure for each weld type The ERW weld $$\mathrm{Log}\ 10(N)=15.370-3\times0.182-4.0\ \mathrm{Log}(380)=4.505 \qquad \text{Class B:}$$

From which N equals $10^{4.505}$=32,000 cycles $$\mathrm{Log}_{10}(N)=14.034-3\times0.204-3.5\ \mathrm{Log}(380)=4.393 \qquad \text{Class C:}$$

From which N equals $10^{4.393}$=24,700 cycles

The maximum number of cycles experienced by the gas pipes is approximately 1600 over a period of 30 years assuming one cycle per week. Ten times this number is 16,000 and this is less than the minimum of 24,700 established using 3 standard deviations. Thus, it meets the ABS requirements with a good margin.

The Circumferential Weld $$\mathrm{Log}_{10}(N)=12.517-3\times0.251-3.0\ \mathrm{Log}(173)=5.05 \qquad \text{Class E:}$$

From which N equals $10^{5.135}$=110,000 cycles $$\mathrm{Log}_{10}(N)=12.237-3\times0.218-3.0\ \mathrm{Log}(173)=4.87 \qquad \text{Class F:}$$

From which N equals $10^{4.87}$=74,000 cycles

Essentially the circumferential weld is approximately three times the capacity of the longitudinal ERW weld.

Figure 10:
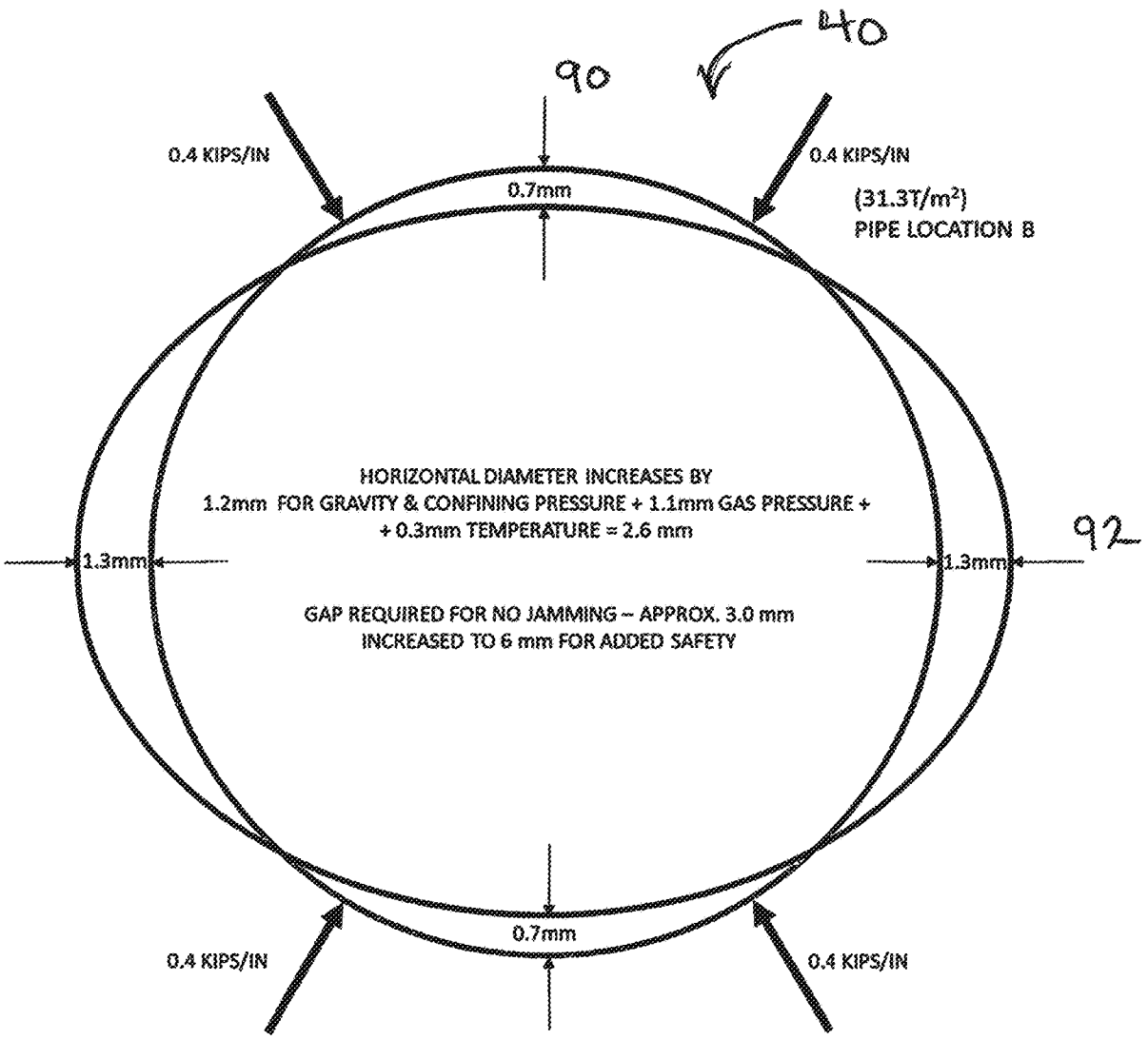
FIG. 10 is a cross-sectional view of a pipe showing an exaggerated view of the pipe distortion that occurs at location B under confining pressure and gravity, gas pressure and differential temperature.

FIG. 10 is an exaggerated view of the pipe distortion that occurs at location B (see, e.g., FIG. 6) under confining pressure and gravity, gas pressure and a differential temperature of the block of pipes 40 being 60 degrees F. above the temperature of hull 22 of transport vessel 10. Gravity and the confining pressure cause the 0.7 mm vertical radial distortion 90. The vertical radial distortion 90 remains at 0.7 mm as the gas pressure and temperature are unable to push it back. Instead, pipe 40 extends in the horizontal axis as shown. The deliberate introduction of a space between adjacent pipes 40 within a row is of major significance. Additionally, the introduction of a space between adjacent pipes 40 within a row makes construction easier as there can be a relatively large tolerance on the exact construction dimension between the walls of holds 18, 20 and vertical girders. The reduction of the co-efficient of lateral pressure from 1 (jammed condition) to 0.35 is significant also.

Still referring to FIG. 10, the vertical contraction of the distorted pipe is 0.7 mm while the horizontal expansion 92 is 1.3 mm. Vertical contraction 90 is less than horizontal expansion 92 because pipe 40 cannot expand upwards under gas pressure and takes the path of least resistance and expands sideways (since there is a gap) because jamming or reactionary forces are unavailable to prevent the movement.

Pipe Weight (9.3 t/m$^2$)

The pipe weight is the total weight of pipe 40 divided by the area of the bottom of the hold, i.e., starboard cargo hold 18 or port cargo hold 20.

Gas weight (1.5 t/m$^2$)

The gas weight is similar to the pipe weight calculation.

Gas temperature effect or 20% g upwards acceleration (2.1 t/m$^2$). The temperature effect results from the pipe being at a higher temperature than the surrounding steel of the vessel causing an increase of stress due to the ship structure not allowing the pipe to expand. Upwards acceleration is the result of the ship motions, such as pitching and heaving, caused by sea waves.

Should there ever be an occasion where the pipe material, e.g., steel, of the entire load of pipes 40 was 60 degrees F. higher than all the surrounding material, e.g., steel, of transport vessel 10, then the material, e.g., steel, of pipe 40 would exert a pressure outward in a manner similar to the gas pressure effect. This would be a very rare occasion and would probably only occur for a very brief period after loading. Therefore, it is considered not to be additive to any accelerations that would occur during a storm at sea. The pressure value is equivalent to a g force of 20% (acting upwards) at the bottom of transport vessel 10.

Figure 11:
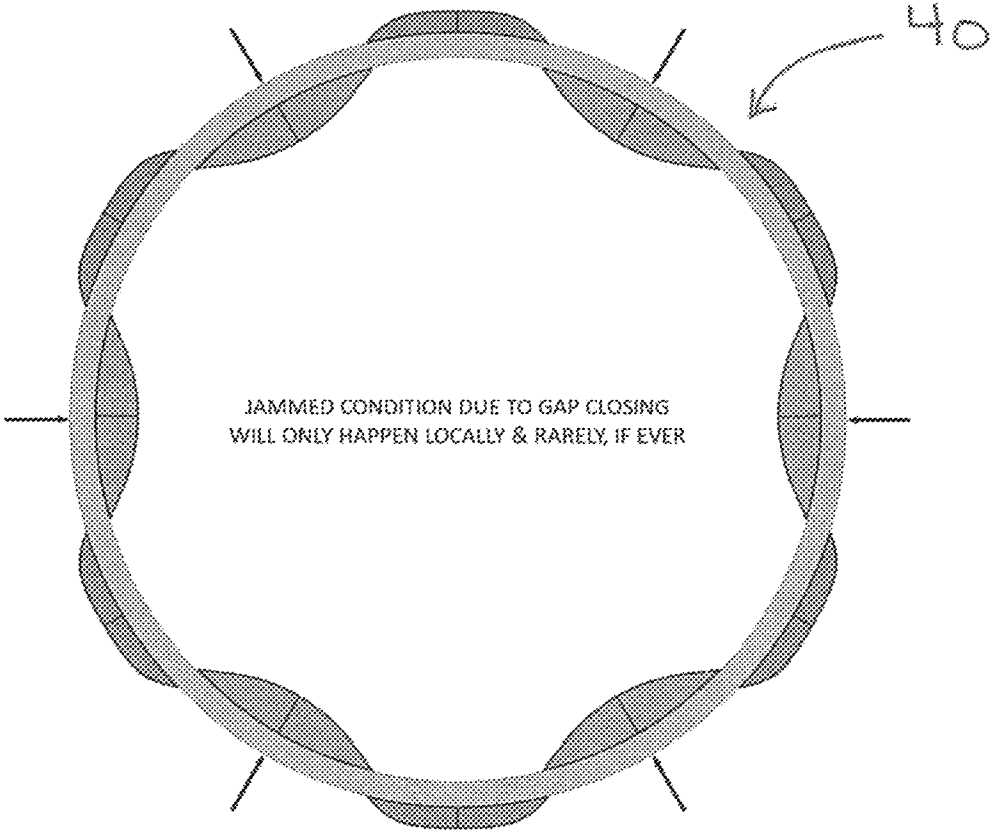
FIG. 11 is a cross-sectional view of a pipe showing changes in membrane stress due to closure of gaps between adjacent pipes.

Referring to FIG. 11, in the jammed condition of pipe 40, all maximum stresses are reduced to 40% of the unjammed equivalent stress. For instance, the pressure of 31.3 t/m$^2$ that would cause a stress of 15 ksi in the unjammed condition would only cause a membrane stress in pipe 40 of 6 ksi in a jammed condition. This confers some small benefit to pipe 40 but the confining girders of bottom support member 24, outside support member 26, internal support member 27, and top support member 28 would experience a small degree of plasticity at their end support points. When gas is removed from pipes 40, there is a small loss to the jacking or confining pressure that could exacerbate over time.

When jacks 34 are tightened to 10 t/m$^2$ for the first time, a pressure test of pipes 40 is implemented to 1.25 times operating pressure or 4500 psi. This initial condition will also cause local packing to occur in regions where pipe 40 may not have made steel-to-steel contact. After the pressure test, upwards deflections of the deck, i.e., fixed top support member 28, and the loads of jacks 34 will be checked. If the loads of jacks 34 have dropped from 10 t/m$^2$ (as they almost certainly will have done) jacks 34 will be retightened and locked off. The response of every single element in the chain, from pipes 40 through the dummy pipes 106 through transverse girders 102, is in the elastic region. Therefore, there should be zero loss to the confining pressure over subsequent repeated cycling.

When gas pipes 44 were being pressure tested, a clamping mechanism was attached to the test pipe. Forces were induced at the contact points to mirror the conditions at the bottom of the stack (Location B). The initial confining force was the equivalent of 19.3 $t/m^2$ and the difference to bring the vectors to match 29.2 $t/m^2$ was self-induced during pressurization (see FIG. 9). The full 30.3 $t/m^2$ was induced as this amount of force is due to rare events and will not occur during weekly cycling.

Figure 12:
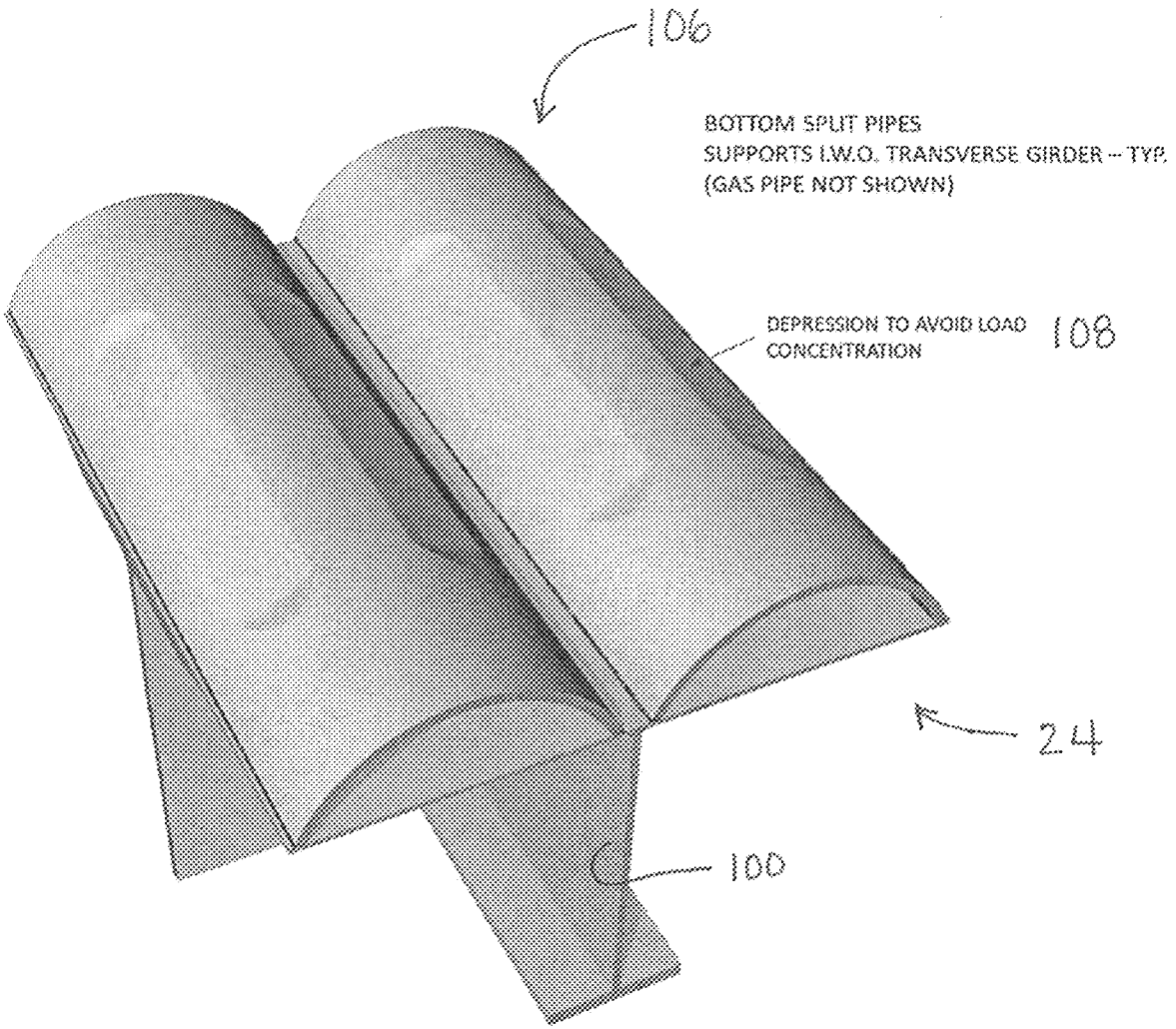
FIG. 12 is a perspective view of a pair of bottom support arches formed from pipe segments above a transverse girder, the bottom support arches having depressions to avoid load concentration.

Referring to FIG. 12, a depression 108 may be introduced in dummy pipes or split pipes 106 at the crossover points, i.e., where pipe 40 crosses over transverse girders 102. Dummy pipes or split pipes 106 are preferably a ⅓ section of pipe of equivalent dimensions to pipe 40 placed convex side up. There is no contact between the gas pipes 44 and supports 100, 102 at the crossover points. The addition of depression 108 in split pipes 106 is an additional mitigative measure and will eliminate the possibility of any local stress concentrations. Should a circumferential weld occur in this region it will not reduce the gap as the weld will have been ground smooth as part of the overall approach.

Referring now to FIGS. 13-17, bottom support members 24 may be made up of longitudinal girders 100 and transverse girders 102. A floor 104 is provided. A row of dummy pipes 106 are located on floor 104.

Figure 15:
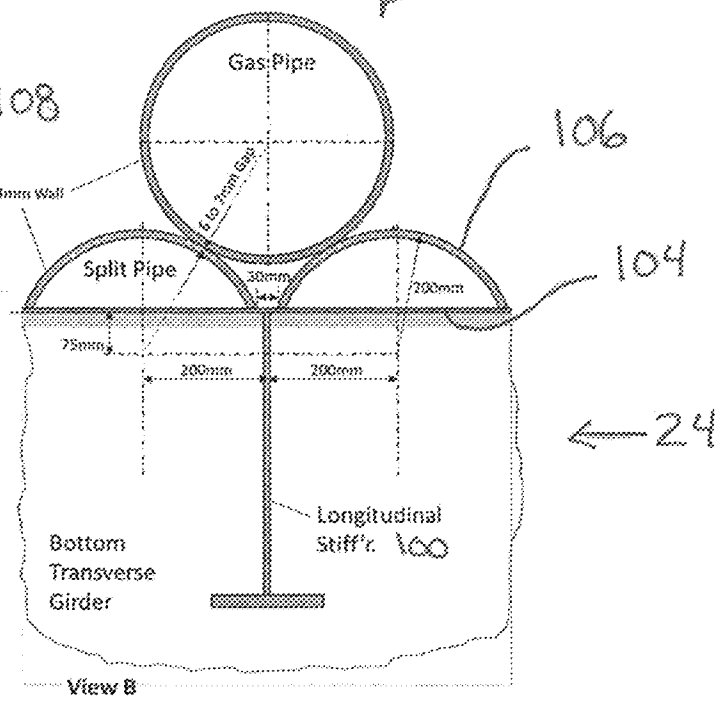
FIG. 15 is an end view of the pair of bottom support arches and gas pipe of FIGS. 12-14.
Figure 14:
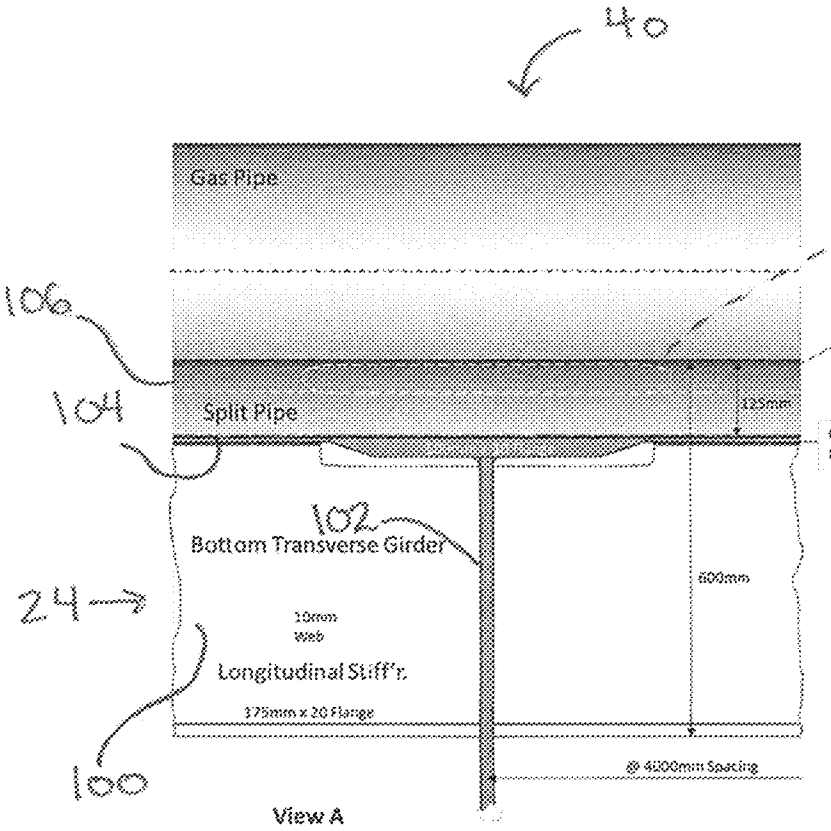
FIG. 14 is a side view of the pair of bottom support arches and gas pipe of FIG. 13.
Figure 16:
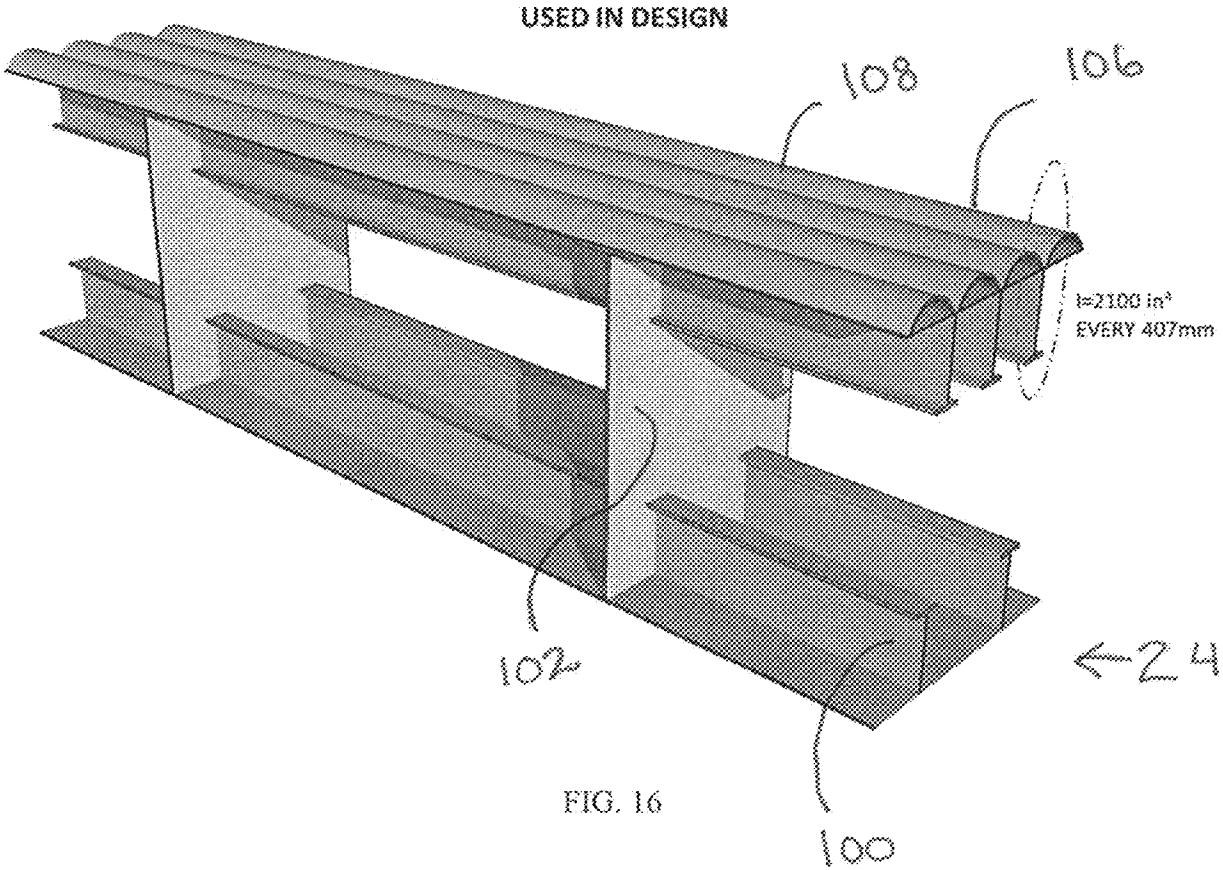
FIG. 16 is a perspective view of a support assembly utilizing the pair of bottom support arches of FIGS. 12-15.

Referring to FIGS. 14-16, a gap of about 7 mm between adjacent pipes 40 within a row is introduced and maintained by welding ⅓ dummy pipes 106 to a 6 mm plate 104 which, in turn, is welded to a longitudinal stiffener 100. The combined effect results in stiffness of 2100 $in^4$ every 407 mm. Note that the ⅓ dummy pipe 106 is preferably the same material and thickness as pipes 40.

Figure 17:
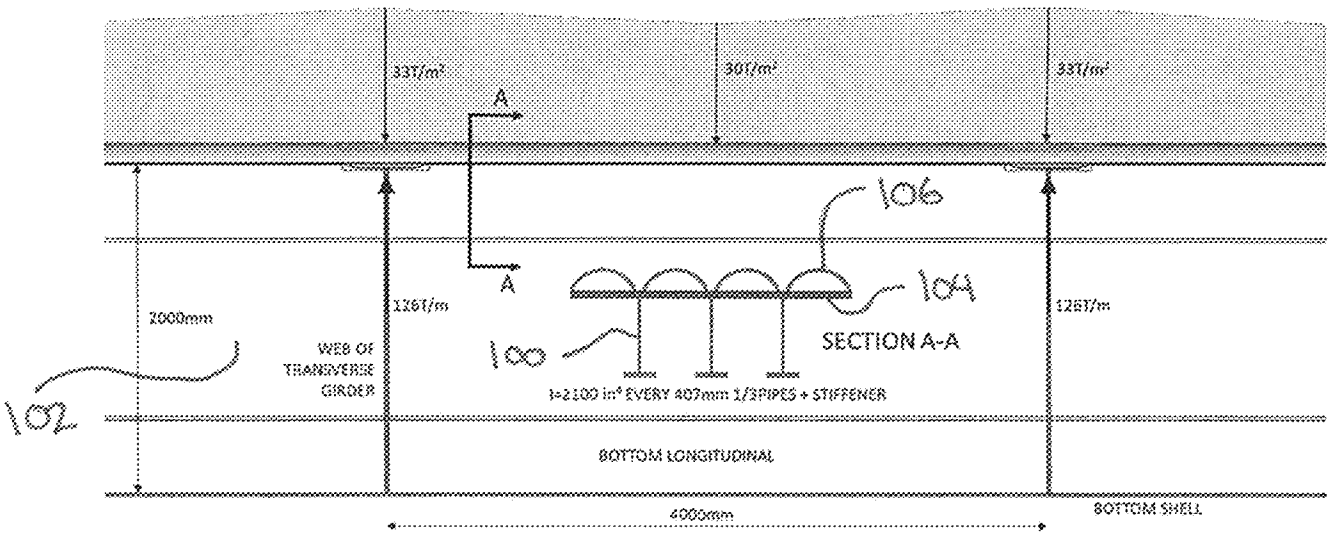
FIG. 17 is an elevation view of the support assembly of FIG. 16 showing loading forces on the bottom support arches.

The gap of 7 mm between pipes 40 within a row allows pipe 40 to expand in a lateral fashion. This makes the group of pipe 40 'softer'. The vertical modulus of elasticity of pipes 40 in an unjammed condition is about 0.1 GPa. Pipes 40 in a jammed condition would be about 55 times stiffer with a modulus of about 5.5 GPa. For comparison, rubber has a modulus of about 0.1 GPa and is similar to pipes 40 in an unjammed condition. Pipes 40 in a jammed condition will have a modulus similar to solid wood. Referring to FIG. 17, we see that the load distribution is only marginally bigger at the supports of transverse girders 102. This is because of the relative softness of pipes 40 in an unjammed condition. To help understand why the deformation equilibrium equations result in such a small difference, it is helpful to imagine that the 12-meter-thick stack of pipes 40 is replaced by a solid rubber block. Now imagine this block of rubber being compressed by the stiffener dummy pipe system (2100 $in^4$ per 16 inches width). It is easy to see that the response will be virtually uniform in nature. Under the maximum pressure the stiffener deflects less than 1 mm in the center relative to its supports (even at the end spans) and the relatively soft stiffness of the pipe block gives the concentration noted above, which is about 5% (33 $t/m^2$/31.3 $t/m^2$).

FIG. 17 shows the concentration rising to around 50 $t/m^2$ if only dummy ⅓ pipes 106 were used without the backup stiffeners.

If pipes 40 were jammed together, the 'rubber' analogy would have to be replaced by 'wood' and the load concentrations would significantly increase at the supports. Thus, the introduction of an expansion gap or space has added benefits in this area also, i.e., as well as not causing a hinge in the transverse girders during gas expansion, the load concentration effect is, for all practical purposes, eliminated.

If all the different effects discussed above are added together, the result is a membrane maximum stress of 16 ksi (15.8 ksi). The membrane maximum stress would only occur in pipe 40 at the lowest row, at the tip of the horizontal axis and in the region of a crossover of bottom transverse girder 102. Dummy pipes 106 are preferably thinned in this area to create depressions 108 to further mitigate any possible problems. The thinning dimensions are minimal, e.g., approximately a few millimeters. The absolute maximum stress possible is, therefore, 53 ksi plus 16 ksi, which includes the pressure concentration factor (see FIG. 17) for a total of 69 ksi. This can be contrasted with the Coselle pipe described in U.S. Pat. No. 9,759,379, the contents of which are hereby incorporated by reference, that successfully passed 65,000 cycles without failure and was plasticized to seven times the strain of first yield during winding. The Coselle pipe subsequently went through a total stress range of about 80 ksi during each cycle due to an ovality effect. The stress range during each cycle for the straight segments of pipe 40 in the instant invention is 50 ksi hoop plus 5 ksi membrane equal to 55 ksi. Therefore, the straight segments of pipe 40 can meet the three-standard deviation test whereas the Coselle pipe could not.

Figure 18:
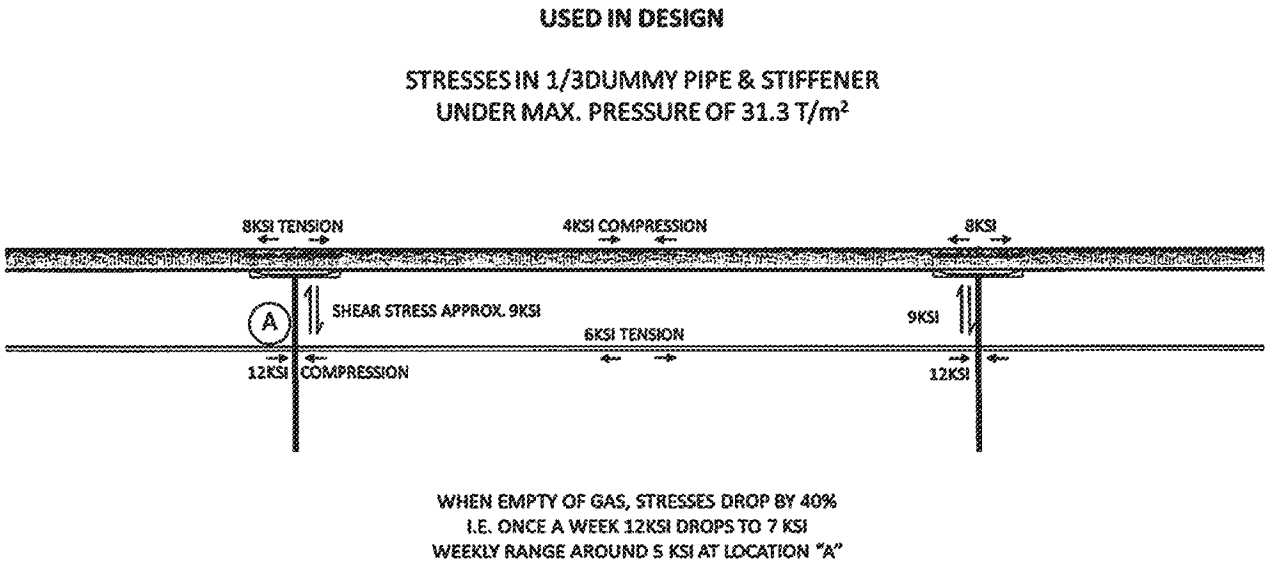
FIG. 18 is an elevation view of a portion of the support assembly of FIGS. 16 and 17 showing loading forces under maximum pressure.

Referring now to FIG. 18, due to its very high relative stiffness and modulus (three times the pipe stiffness) the combined dummy pipe stiffener experiences very low levels of stress. The stress range due to weekly cycling is only about 5 ksi at location A in FIG. 18.

It is desirable to ensure that all of the pipes are pressed uniformly by the confining or jacking pressure even though all of pipes 40 may not be flush. For example, the space between forcing beam 36 and a top layer of pipe 40 could be filled with leveling material such as concrete. Another way to insure that the pipes are pressed uniformly is to install wedges between pipes 40 that are fastened to the top beam 36.

Figure 19:
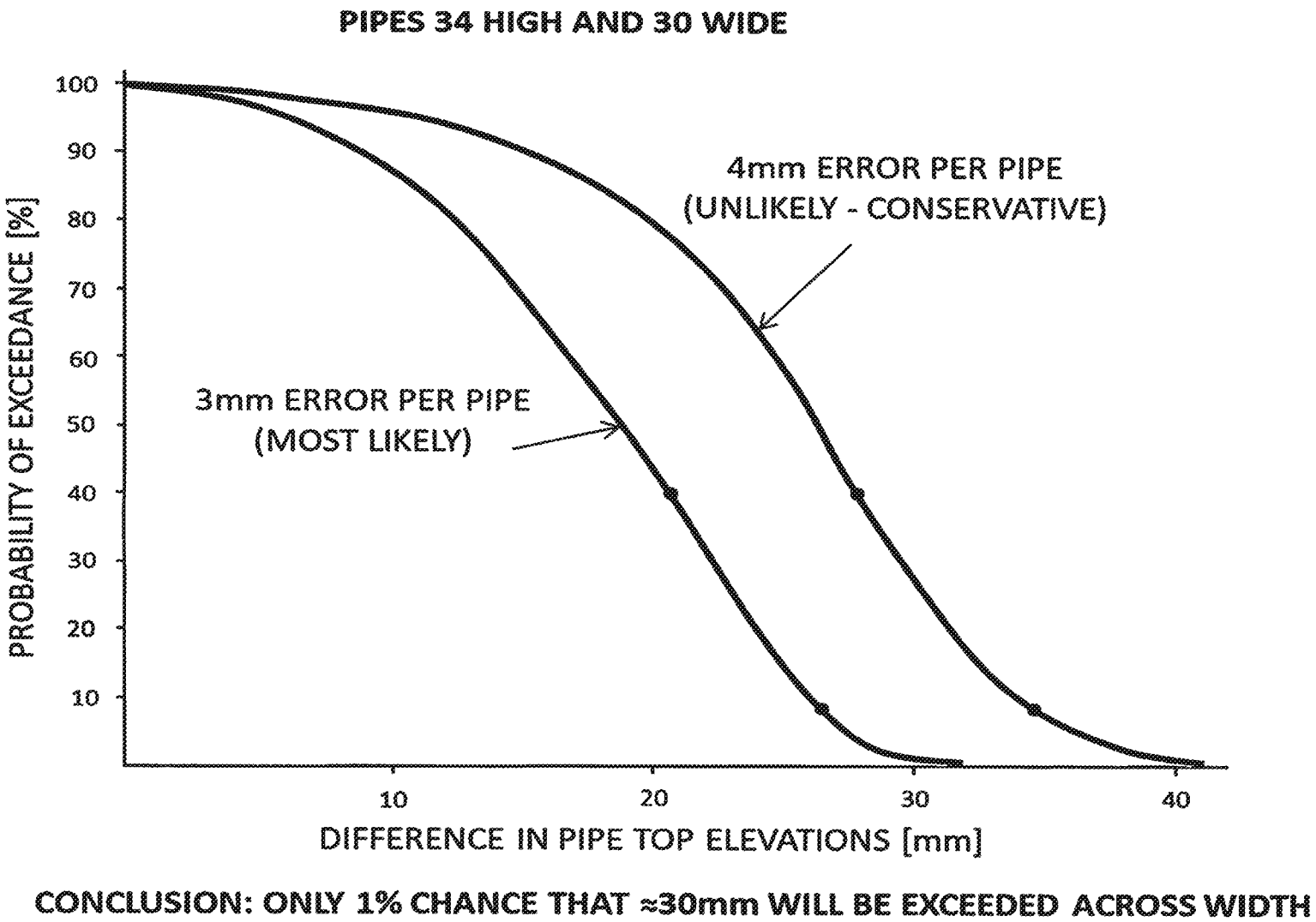
FIG. 19 is a graph demonstrating a probability of uneven top surface on the uppermost row of a stack of pipes such as may be seen in FIG. 6.

Referring now to FIG. 19, shown is a graphical representation of a probability of exceeding a difference in elevations of the tops of plurality of pipes 40 when pipes 40 are stacked 34 high and 30 wide. Due to inaccuracies during the manufacturing process, the probability that very small differences in pipe top elevations approach 100% probability. As can be seen by reference to the graph, a 50% probability of exceeding a 20 mm difference in pipe top elevations exists with a 3 mm error per pipe, which is believed to be most likely. It is estimated that 50% probability exceeding a 28 mm difference in pipe top elevations if the pipes are determined to be 4 mm error per pipe, which is believed to be a conservative estimate that is unlikely. In conclusion, it is estimated that there exists only a 1% chance that an approximately 30 mm difference in pipe top elevations will be exceeded.

Figure 20:
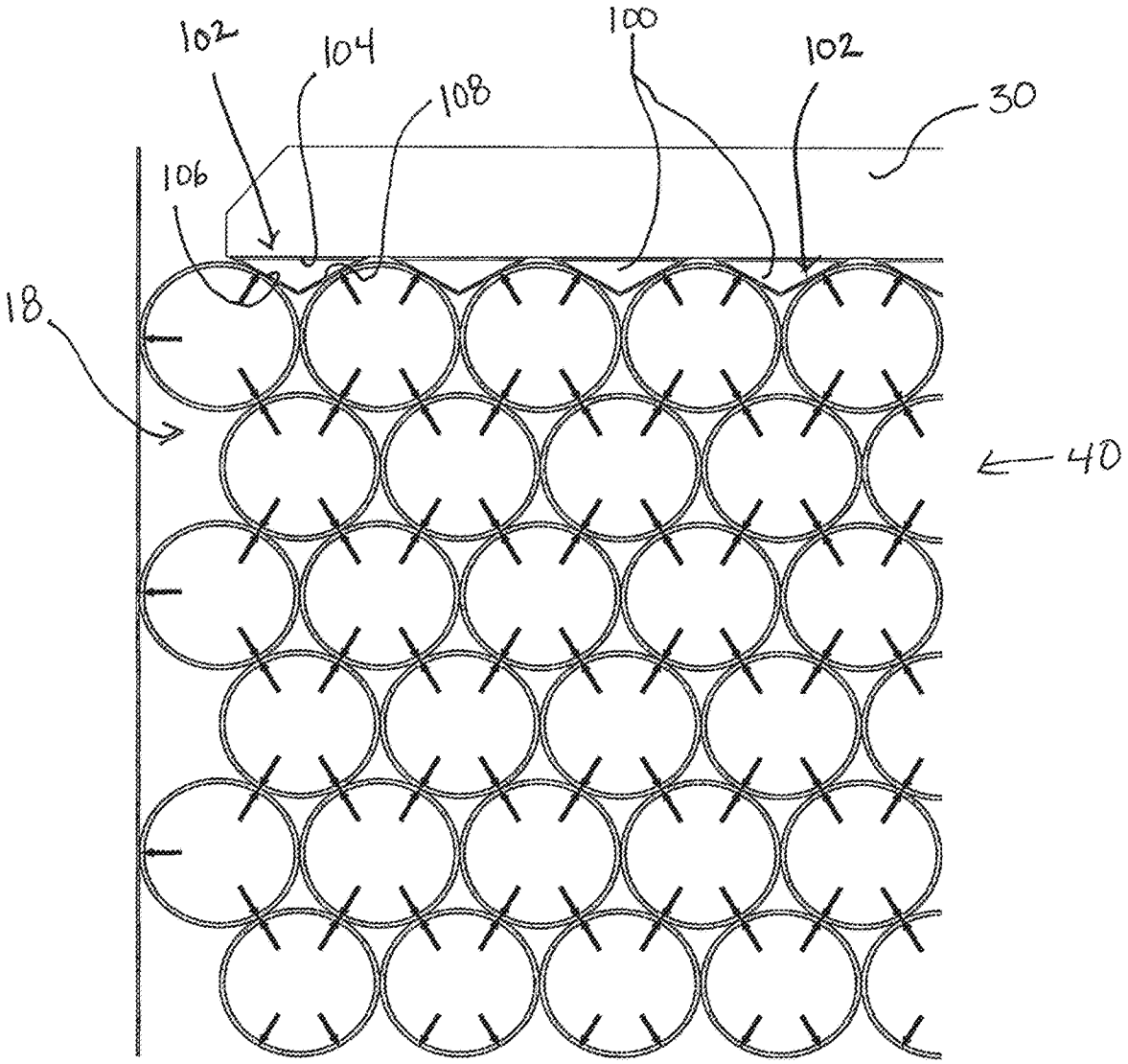
FIG. 20 is a cross-sectional view of pipes stacked beneath a forcing member with load distributing wedges between the forcing member and a top row of the pipe. The pipe is shown with force vector triangles.

Referring now to FIG. 20, shown is a plurality of pipes 40 located in starboard cargo hold 18. Forcing member 30 is positioned above plurality of pipes 40. A plurality of load equalizers 100 may be seen on top of an uppermost row of pipes 40. In one embodiment, load equalizer 100 is a pressure wedge 102. Pressure wedges 102 have a force member engaging side 104, a first pipe engaging side 106, and a second pipe engaging side 108. Pressure wedges 102 preferably have dimensions related to the dimensions of the pipe in the following way: wedges 102 must be dimensioned so that when pressed between the two adjacent pipes the two surface of wedge 102 will contact each of the adjacent pipes. There are a range of dimensions that will meet this requirement that are easily determined by those skilled in the art. In one example, wedge 102 extends away from force engaging side 104 of pressure wedge 102 by a distance that is approximately ⅓ of the diameter of the pipes. In one embodiment, pressure wedge 102 is comprised of approximately 250 tons of steel. Pressure wedge 102 is self-leveling and is free to move left and right. Pressure wedge 102 is preferably constructed of steel and is deformable under design loading.

Figure 21:
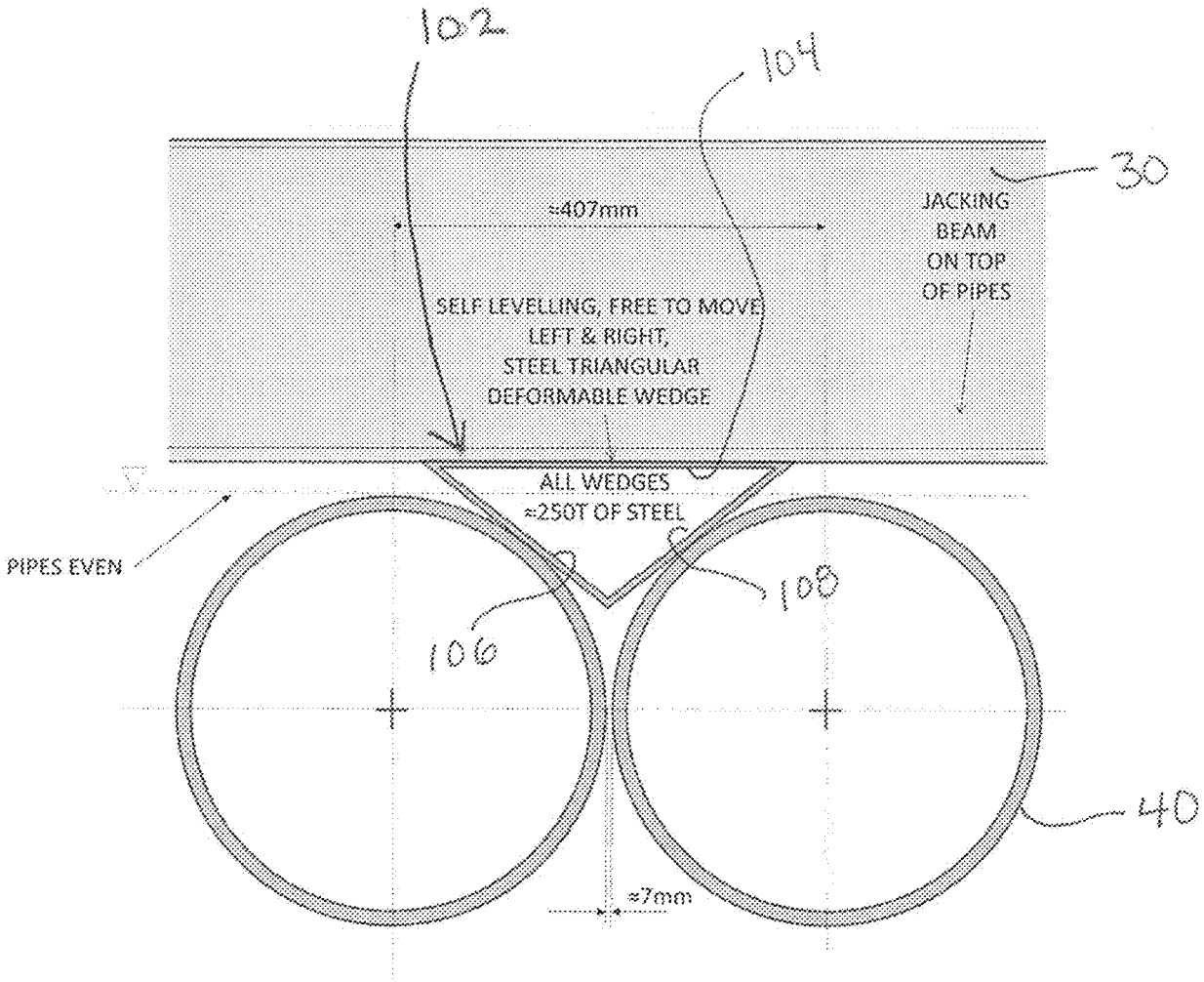
FIG. 21 is a cross-sectional elevation view of two pipes with a wedge therebetween acted on by the forcing beam.

Referring to FIG. 21, shown is a pressure wedge 102 located such that force member engaging side 104 is engaged with forcing member 30. First pipe engaging side 106 is in contact with one of pipes 40 and a second pipe engaging surface 108 is in contact with a second one of pipes 40. FIG. 21 shows a condition where each of pipes 40 are even and pressure wedge 102 is positioned therebetween.

Figure 22:
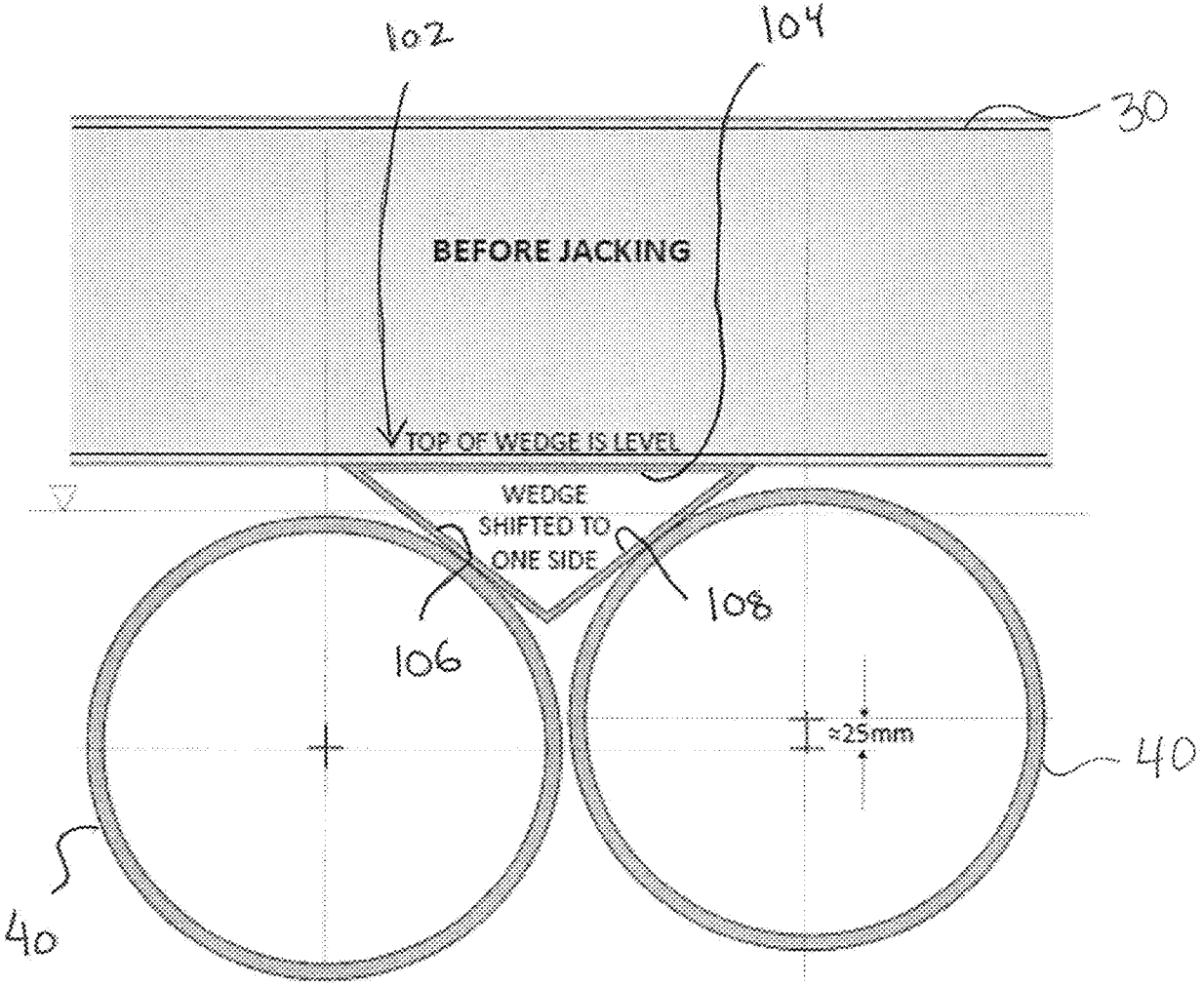
FIG. 22 is a cross-sectional elevation view of the pipes and wedge of FIG. 11 shown on uneven pipes before jacking.

Referring now to FIG. 22, pressure wedge 102 is shown between two of pipes 40 wherein each of pipes 40 are not level with one another. As can be seen from FIG. 22, right pipe 40 is shown approximately 25 mm higher than left pipe 40. Therefore, in an unloaded condition, i.e., before jacking of force member 30, pressure wedge 102 is shown shifted to the left.

Figure 23:
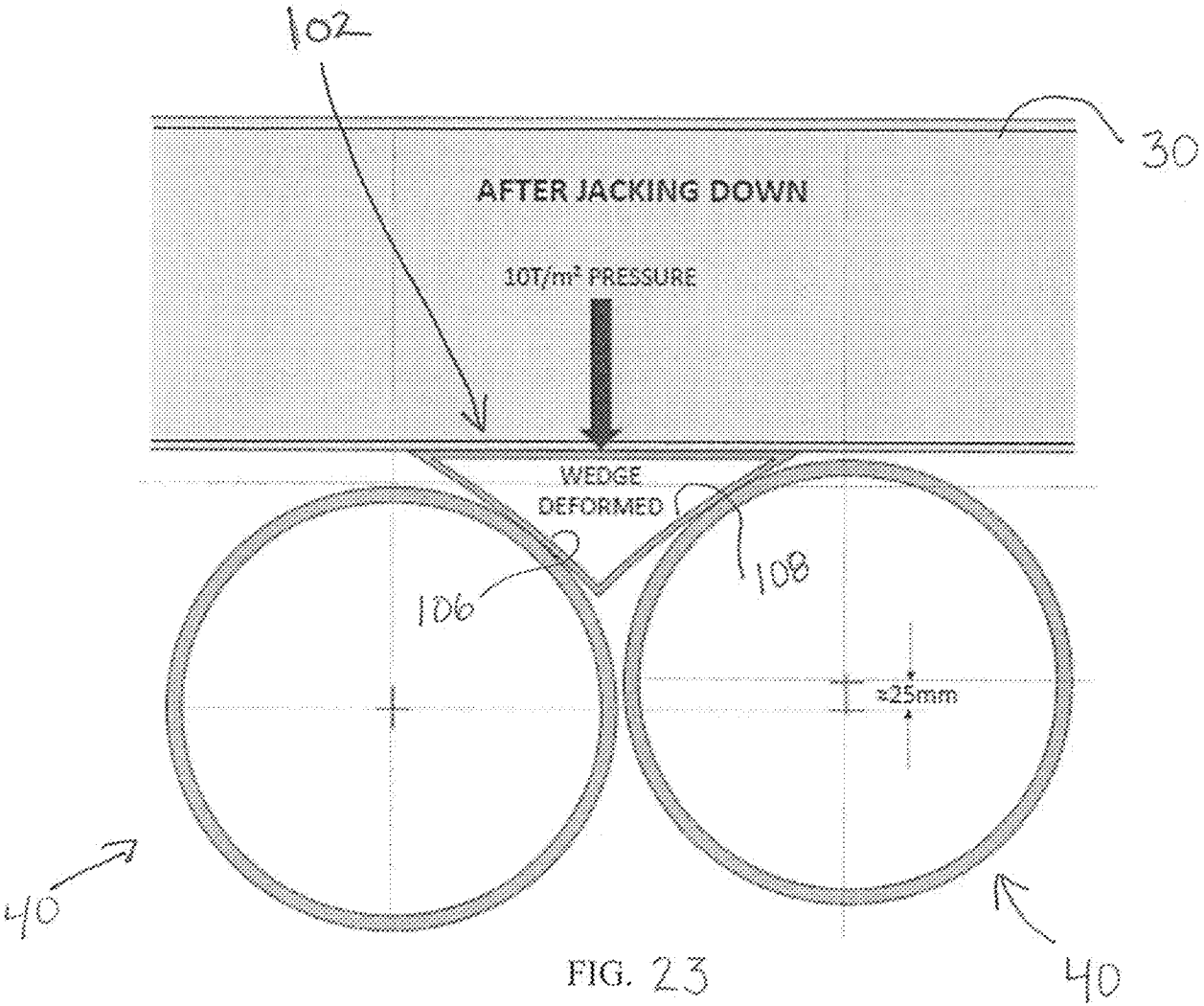
FIG. 23 is an elevation view of the pipes and wedges of FIG. 11 shown on uneven pipes after jacking.

Referring now to FIG. 23, shown is pressure wedge 102 being deformed by forcing member 30 under jacking pressure of 10 tons per meter squared (10 tons/meter$^2$). As can be seen from FIG. 23, first pressure engaging side 106 and second pressure engaging side 108 are deformed by the jacking pressure.

Figure 24:
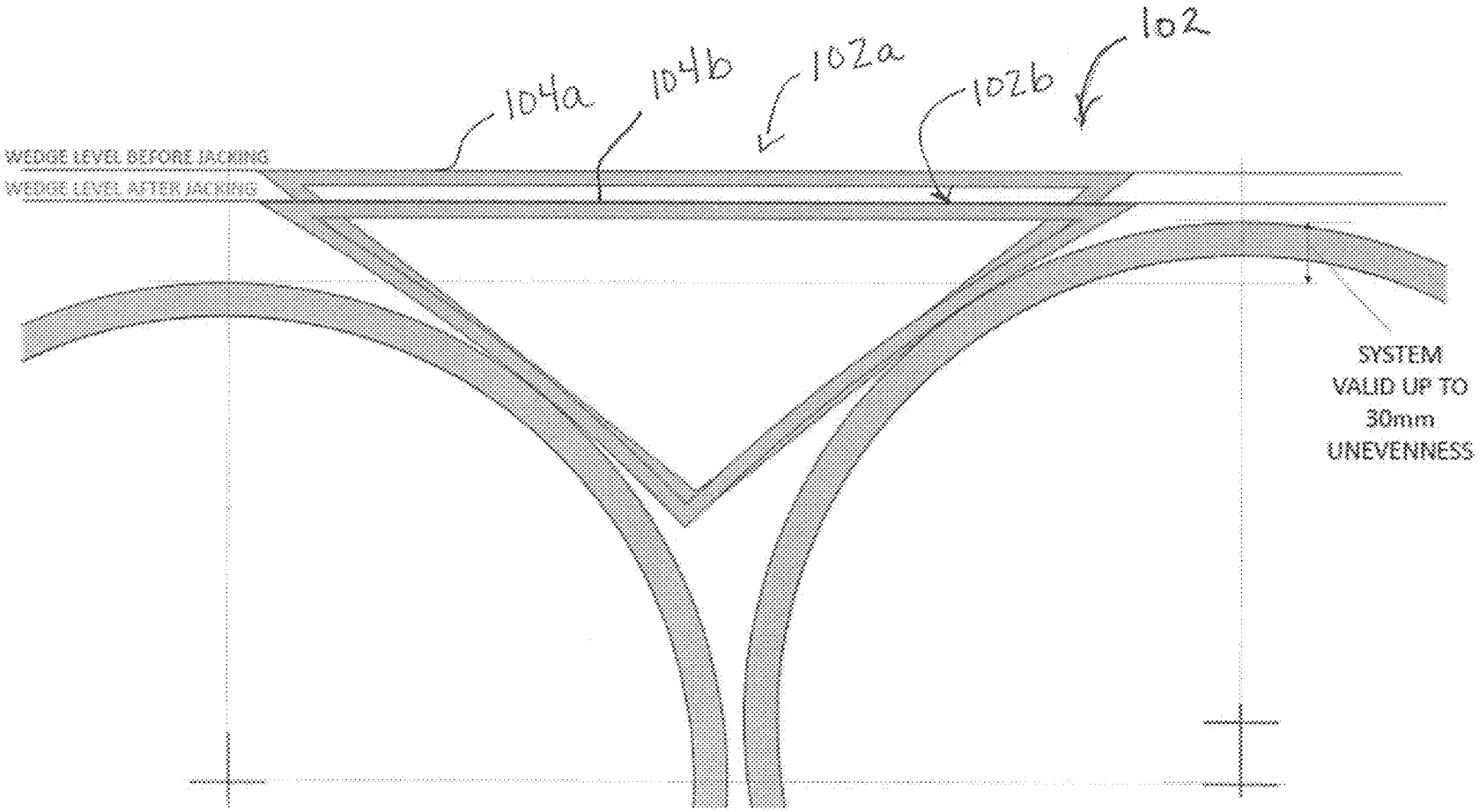
FIG. 24 is an enlarged view of the wedges and pipes of FIGS. 12 and 13.

As can be seen in FIG. 24, an enlarged view of pressure wedge 102 is shown comparing the configuration of unloaded pressure wedge 102*a* in an unloaded condition, as shown in FIG. 22, with a deformed or loaded pressure wedge 102*b*, as shown in FIG. 23. As can be seen in FIG. 24, the force member engaging surface 104*b* of loaded pressure wedge 102*b* is lower after being subjected to jacking pressure from force member 30 as compared to force member engaging surface 104*a* of unloaded pressure wedge 102*a*.

Figure 25:
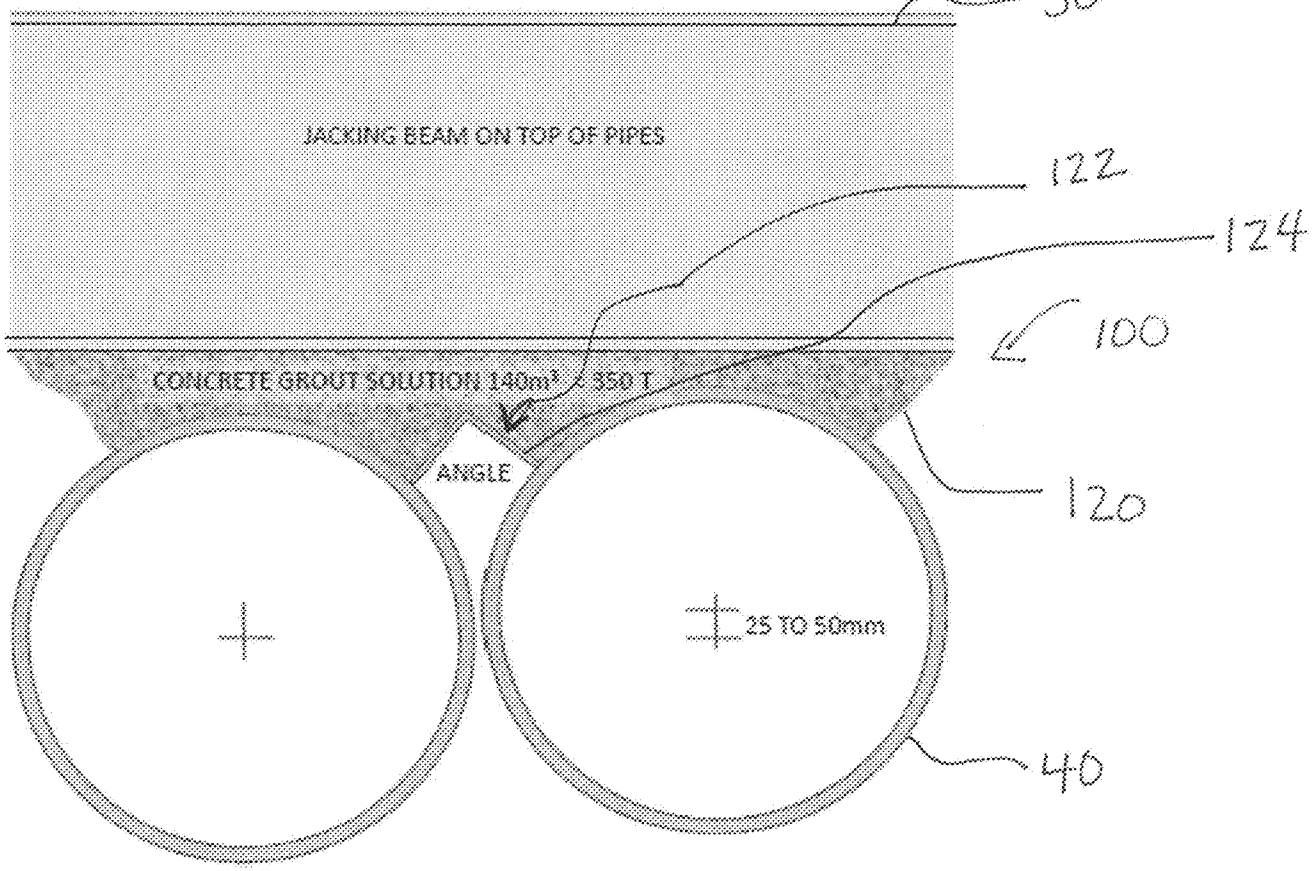
FIG. 25 is a cross-sectional elevation view of a load distributing embodiment utilizing a smoothing layer on uneven pipes, e.g., a concrete grout solution.

Referring now to FIG. 25, shown is a second embodiment of load equalizer 100. In a second embodiment, load equalizer 100 is a flowable material 120. Flowable material 120 may be a concrete grout solution. Other examples of flowable material 120 include a gel that solidifies after a certain amount of time. In a preferred embodiment, a stopper 122 is positioned between adjacent ones of pipe 40. Stopper 122 may be a longitudinal angle member 124 for preventing flowable material 120 from leaking between adjacent ones of pipe 40. As can be seen in FIG. 25, flowable material 120 functions as load equalizer 100 by compensating for differences in height of adjacent ones of pipe 40.

Although particular embodiments have been described herein, it will be appreciated that the invention is not limited thereto and that many modifications and additions thereto may be made within the scope of the invention. For example, various combinations of the features of the following dependent claims can be made with the features of the independent claims without departing from the scope of the present invention.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. An assembly for transporting fluid comprising:

a cargo hold in or on a transport vessel, said cargo hold including a lower support, a first side support on a first side of the lower support, and a second side support on a second side of said lower support;

a plurality of pipes for fluid containment received in said cargo hold, wherein said plurality of pipes is stacked in multiple rows, wherein adjacent pipes have two points of contact between adjacent rows and wherein adjacent pipes in a same row are separated from one another by a space;

a forcing member above said plurality of pipes;

a forcing mechanism for applying a sufficient compressive force to said plurality of pipes with said forcing member so that friction between the pipes will prevent any significant relative movement of the pipes caused by motions of the transport vessel, or by flexing of the transport vessel, or by strains caused by differential temperature or pressure; and a fluid line system connected to said plurality of pipes for filling and unloading fluid to the pipes.

2. The assembly of claim 1 further comprising:

a plurality of spacers adjacent said lower support for supporting said plurality of pipes, said spacers for creating said gap between adjacent ones of said pipe in a same row of said plurality of pipes.

3. The assembly of claim 2 wherein:

said plurality of spacers are a plurality of arches adjacent said lower support for supporting said plurality of pipes, said arches oriented convex side up, said arches for creating said gap between adjacent ones of said pipe in said plurality of pipes.

4. The assembly of claim 3 wherein said split pipes are ⅓ segments of pipe of a same size as pipe in said plurality of pipes.

5. The assembly of claim 1 where the pipes are made from steel.

6. The assembly of claim 1 where the fluid containment pipes are surrounded by a plurality of empty pipes or half pipes of substantially the same outer diameter of the fluid containment pipes.

7. The assembly of claim 1 where the forcing mechanism is a plurality of jacks between the hold down beam and the top fixed deck of the hold.

8. The assembly of claim 1 wherein a friction element is placed between the pipes. This friction element could be a roughening of the pipe surface or otherwise preparing the pipe surface to maximize friction between the pipes.

9. The assembly of claim 1 where the space in the cargo hold is filled with an inert gas.

10. The assembly of claim 1 wherein the forcing mechanism includes a tightening mechanism to permit pressing the upper forcing member down over the plurality of pipes after the first force is applied to accommodate settling in the plurality of pipes.

11. The assembly of claim 1 wherein:

a load equalizer below said forcing member, said load equalizer engaging said forcing member and at least two pipes of said plurality of pipes for distributing said compressive force to said at least two pipes of said plurality of pipes.

12. The assembly of claim 11 wherein:

said load equalizer is a pressure wedge having a force member engaging side, a first pipe engaging side, and a second pipe engaging side.

13. The assembly of claim 11 wherein said load equalizer is a flowable material.

14. The assembly of claim 13 wherein said flowable material is a concrete grout solution.

15. The method of transporting gas in a plurality of stacked pipes carried on or in a vessel comprising the steps of:

locating a plurality of pipes in a cargo hold of a vessel;

maintaining a space between adjacent pipes in a same row of said plurality of stacked pipes, forcing the pipes together so strongly that any motion of the vessel, including flexing of the vessel itself, does not induce relative motion between the pipes themselves or between the pipes and the vessel;

wherein said step of locating said plurality of pipes comprises stacking said plurality of pipes on a plurality of split pipes, said split pipes oriented convex side up.

16. The method according to claim 15 wherein said step of maintaining comprises stacking said plurality of pipes on a plurality of spacers for creating a gap between adjacent ones of said pipe in a same row of said pipe.

17. The method according to claim 15 wherein said split pipes are ⅓ segments of pipe of a same size as pipe in said plurality of pipes.

18. The method of claim 15 where the vessel is a barge.

19. The method of claim 15 where the vessel is a ship.

20. The method of claim 15 where the pipes are pressure vessels.

21. The method of claim 15 where the pipes carry compressed gas.

22. A method of transporting gas in a plurality of stacked pipes carried on or in a vessel comprising the steps of:

locating a plurality of pipes in a cargo hold of a vessel;

maintaining a space between adjacent pipes in a same row of said plurality of stacked pipes;

forcing the pipes together so strongly that any motion of the vessel, including flexing of the vessel itself, does not induce relative motion between the pipes themselves or between the pipes and the vessel; and placing a load equalizer above said plurality of pipes.

23. The method according to claim 22 wherein said step of placing said load equalizer comprises placing at least one wedge between adjacent pipes on a top row of said plurality of stacked pipes.

24. The method according to claim 15 wherein said step of placing a load equalizer comprises flowing a flowable material to cover at least a portion of a top row of pipes of said plurality of stacked pipes.

25. A method of transporting gas in a plurality of stacked pipes carried on or in a vessel comprising the steps of:

locating a plurality of pipes in a cargo hold of a vessel;

maintaining a space between adjacent pipes in a same row of said plurality of stacked pipes;

forcing the pipes together so strongly that any motion of the vessel, including flexing of the vessel itself, does not induce relative motion between the pipes themselves or between the pipes and the vessel;

wherein said step of placing a load equalizer comprises flowing a flowable material to cover at least a portion of a top row of pipes of said plurality of stacked pipes;

wherein said flowable material is a concrete grout solution.

26. A fluid transport assembly comprising:

a lower support having a first side and a second side;

a first side support adjacent to said first side of said lower support;

a second side support adjacent to said second side of said lower support;

wherein said first side support, said lower support and said second side support define a pipe receiving area;

a row of spacers adjacent said lower support;

a plurality of pipes stacked in multiple rows between said first side support and said second side support in said pipe receiving area, said plurality of pipes defining an upper side, a lower side, a first side and a second side, said lower side supported by said row of spacers;

a top support above said pipe receiving area;

wherein said adjacent pipes in said plurality of pipes having two points of contact between adjacent rows and where adjacent pipes in the same row are separated from one another by a space;

a forcing member adjacent one of said sides of said plurality of pipes, said forcing member for forcefully applying pressure to said plurality of pipes for applying compressive force to said plurality of pipes for increasing static friction between adjacent ones of said plurality of pipes and between ones of said plurality of pipes and adjacent structure selected from said lower support, said first side support, said second side support and said top support.

27. The assembly of claim 26 wherein:

said row of spacers are a plurality of arches adjacent said lower support for supporting said plurality of pipes, said arches oriented convex side up, said arches for creating said gap between adjacent ones of said pipe in said plurality of pipes.

28. The assembly of claim 27 wherein said arches are ⅓ segments of pipe of a same size as pipe in said plurality of pipes.

29. The fluid transport assembly according to claim 26 further comprising:

a forcing mechanism for applying a force to said forcing member in a force direction; and further comprising bracing structure for providing restraint in a direction perpendicular to said force direction.

30. The fluid transport assembly according to claim 26 further comprising:

stress spreading structure for spreading concentrated stresses generated by compressive forces exerted by said forcing mechanism.

31. The fluid transport assembly according to claim 30 wherein said stress spreading structure is a layer of empty pipe between said forcing mechanism and said plurality of pipes.

32. The fluid transport assembly according to claim 30 wherein said stress spreading structures is a layer of empty pipe surrounding said plurality of pipes.

33. The fluid transport assembly according to claim 26 further comprising a means for connecting each one of said plurality of pipes to a filling or emptying mechanism.

34. The fluid transport assembly according to claim 26 wherein:

said plurality of pipe defines an outer layer of pipe and an interior grouping of pipe; and wherein said outer layer of pipe for remaining empty and for distributing loads generated by a forcing mechanism.

35. An assembly for transporting fluid comprising:

a cargo hold on or in a transport vessel, said cargo hold including a lower support having a first side and a second side, a first side support on said first side of said lower support, and a second side support on said second side of said lower support;

a plurality of pipes for fluid containment received in said cargo hold wherein said plurality of pipes is stacked in multiple rows, wherein adjacent pipes of said plurality of pipes have two points of contact between adjacent rows of said multiple rows;

a forcing member above said plurality of pipes;

a forcing mechanism for applying a compressive force to said plurality of pipes via said forcing member, said compressive force being sufficient so that friction between pipes of said plurality of pipes prevents any significant relative movement of pipes of said plurality of pipes;

a load equalizer below said forcing member, said load equalizer engaging said forcing member and at least two pipes of said plurality of pipes for distributing said compressive force to said at least two pipes of said plurality of pipes;

a fluid line system connected to said pipes of said plurality of pipes for filling and unloading fluid to the pipes.

36. The assembly of claim 35 wherein:

said load equalizer is a pressure wedge having a force member engaging side, a first pipe engaging side, and a second pipe engaging side.

37. The assembly of claim 36 wherein:

said pressure wedge is deformable under design loading.

38. The assembly of claim 35 wherein said load equalizer is a flowable material.

39. The assembly of claim 35 wherein said flowable material is a concrete grout solution.

40. The assembly of claim 35 where said pipes of said plurality of pipes are comprised of steel.

41. The assembly of claim 35 wherein:

said adjacent pipes in a same row are separated by from one another by a space.

42. The assembly of claim 41 further comprising:

a plurality of spacers adjacent said lower support for supporting said plurality of pipes, said spacers for creating said space between adjacent ones of said pipe in a same row of said plurality of pipes.

43. The assembly of claim 35 wherein:

said transport vessel comprises a top fixed deck;

said forcing mechanism comprises a plurality of jacks between said forcing member and said top fixed deck.

44. The assembly of claim 35 wherein:

said forcing mechanism comprises a tightening mechanism for permitting pressing of the forcing member onto said plurality of pipes after a first force is applied for accommodating settling of pipes in said plurality of pipes.

45. A method of transporting gas in a plurality of stacked pipes carried on or in a vessel comprising the steps of:

locating the plurality of stacked pipes in a cargo hold of the vessel;

placing a load equalizer above said plurality of stacked pipes;

forcing said pipes of said plurality of stacked pipes together so strongly that any motion of the vessel, including flexing of the vessel itself, substantially eliminating relative motion between said pipes of said plurality of said stacked pipes, or between said pipes, and the vessel.

46. The method according to claim 45 wherein said step of placing said load equalizer comprises placing at least one wedge between adjacent pipes on a top row of said plurality of stacked pipes.

47. The method according to claim 46 wherein said step of placing at least one wedge comprises locating a point of said wedge between adjacent pipes and locating a flat surface of said wedge adjacent a forcing member.

48. The method according to claim 45 wherein said step of placing a load equalizer comprises flowing a flowable material to cover at least a portion of a top row of pipes of said plurality of stacked pipes.

49. The method according to claim 48 wherein said flowable material is a concrete grout solution.

50. The method of claim 45 further comprising the step of:

maintaining a space between adjacent pipes in a same row of said plurality of stacked pipes.

51. The method of claim 50 wherein said step of maintaining comprises stacking said plurality of pipes on a plurality of spacers for creating a gap between adjacent ones of said pipe in a same row of said pipe.

* * * * *